US011725895B2

(12) United States Patent
Underwood et al.

(10) Patent No.: US 11,725,895 B2
(45) **Date of Patent: *Aug. 15, 2023**

(54) FIREARM OPERATING SYSTEM

(71) Applicants: James Matthew Underwood, Kennesaw, GA (US); Larry Cullen Underwood, Canton, GA (US)

(72) Inventors: James Matthew Underwood, Kennesaw, GA (US); Larry Cullen Underwood, Canton, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/862,834

(22) Filed: Jul. 12, 2022

(65) Prior Publication Data

US 2022/0364813 A1 Nov. 17, 2022

Related U.S. Application Data

(63) Continuation of application No. 16/920,258, filed on Jul. 2, 2020, now Pat. No. 11,421,954, which is a continuation of application No. 15/365,523, filed on Nov. 30, 2016, now Pat. No. 10,739,095.

(60) Provisional application No. 62/261,566, filed on Dec. 1, 2015.

(51) Int. Cl.

| | |
|---|---|
| ***F41A 19/10*** | (2006.01) |
| ***F41C 3/00*** | (2006.01) |
| ***F41A 19/43*** | (2006.01) |
| ***F41A 19/11*** | (2006.01) |
| ***F41A 17/56*** | (2006.01) |
| ***F41A 9/59*** | (2006.01) |
| ***F41A 19/30*** | (2006.01) |
| ***F41A 17/28*** | (2006.01) |
| ***F41A 17/72*** | (2006.01) |

(52) U.S. Cl.

CPC ..... *F41A 19/10* (2013.01); *F41A 9/59* (2013.01); *F41A 17/28* (2013.01); *F41A 17/56* (2013.01); *F41A 17/72* (2013.01); *F41A 19/11* (2013.01); *F41A 19/30* (2013.01); *F41A 19/43* (2013.01); *F41C 3/00* (2013.01)

(58) Field of Classification Search

CPC .. F41A 19/10; F41A 9/59; F41A 17/28; F41A 17/56; F41A 17/72; F41A 19/11; F41A 19/30; F41A 19/43; F41C 3/00

See application file for complete search history.

(56) References Cited

U.S. PATENT DOCUMENTS

| | | | |
|---|---|---|---|
| 1,085,698 | A | 2/1914 | Nelson |
| 1,168,024 | A | 1/1916 | Nelson |
| 1,349,345 | A | 8/1920 | Payne |
| 2,182,693 | A | 12/1939 | Harton |
| 2,691,232 | A | 10/1954 | Hoopes |
| 2,978,826 | A | 4/1961 | Ivy |
| 3,415,000 | A | 12/1968 | Koucky et al. |
| 3,715,826 | A | 2/1973 | Seifried |
| 4,031,648 | A | 6/1977 | Thomas |

(Continued)

*Primary Examiner* — Michelle Clement

(57) ABSTRACT

A firearm operating system includes a housing, a central pivoting member disposed within the housing, a trigger including a portion disposed within the housing and a portion extending outside the housing such that the portion of the trigger within the housing includes a hole and at least one finger that extends in a first direction from the hole. Due to movement of the trigger, the at least one finger presses against the central pivoting member to cause the central pivoting member to rotate.

20 Claims, 26 Drawing Sheets

(56) References Cited

U.S. PATENT DOCUMENTS 4,246,830 A 1/1981 Krieger
4,420,899 A 12/1983 Bourlet et al.
4,521,985 A 6/1985 Smith et al.
4,549,465 A 10/1985 Charron
4,594,935 A 6/1986 Smith
4,619,062 A 10/1986 Johnson
4,742,634 A 5/1988 Swenson
4,815,226 A 3/1989 Ruger
4,915,011 A * 4/1990 Smith ..... F41A 5/02 89/196
5,036,612 A 8/1991 Jennings
5,090,147 A 2/1992 Pastor
5,105,570 A 4/1992 Lishness et al.
5,299,374 A 4/1994 Mathys
5,386,659 A 2/1995 Vaid et al.
5,388,362 A 2/1995 Melcher
5,438,784 A 8/1995 Lenkarski et al.
5,537,769 A 7/1996 Hargraves et al.
5,640,794 A 6/1997 Gardner et al.
5,655,326 A * 8/1997 Levavi ..... F41A 19/34 89/196
5,741,996 A * 4/1998 Ruger ..... F41A 3/66 89/196
5,926,987 A 7/1999 Novak
6,073,380 A 6/2000 Hauser et al.
6,141,895 A 11/2000 Rost et al.
6,374,526 B1 4/2002 Mochak
6,457,271 B1 10/2002 Vaid et al.
6,655,066 B2 12/2003 Fluhr
6,665,973 B1 12/2003 Peev
6,820,606 B1 11/2004 Duffey
6,880,281 B1 4/2005 Or
7,140,141 B2 11/2006 Vaid
7,194,833 B1 3/2007 Curry
7,243,452 B2 * 7/2007 Zeh ..... F41A 19/16 42/69.01
7,263,796 B2 * 9/2007 Kellermann ..... F41A 19/47 89/147
7,516,570 B2 4/2009 Stone
7,617,628 B2 11/2009 Curry
7,703,230 B2 4/2010 Curry et al.
7,810,268 B1 10/2010 McGarry
7,810,269 B2 10/2010 Zukowski et al.
7,861,449 B1 * 1/2011 Zajk ..... F41A 3/66 42/62
7,866,077 B2 1/2011 Constant et al.
7,930,848 B2 4/2011 Dye, Jr.
7,958,661 B2 6/2011 Strayer
8,015,742 B2 9/2011 Zedrosser
8,033,043 B2 10/2011 McGarry
8,112,926 B2 * 2/2012 Gussalli Beretta ..... F41A 17/38 42/6
8,117,779 B2 * 2/2012 Doll ..... F41A 17/42 42/69.01
8,122,634 B2 2/2012 Constant et al.
8,191,298 B2 6/2012 Cash et al.
8,220,193 B1 * 7/2012 Lynch ..... F41A 19/16 42/70.08
8,250,799 B2 * 8/2012 Duperry ..... F41A 19/16 42/42.02
8,438,768 B2 5/2013 Kallio
8,459,172 B2 * 6/2013 Landies ..... F41A 19/01 89/128
8,505,225 B1 * 8/2013 Degener ..... F41A 19/10 42/69.01
8,572,878 B2 11/2013 Gentilini et al.
8,601,932 B1 * 12/2013 Karfiol ..... F41A 19/12 42/69.02
8,656,619 B2 2/2014 Popikov
8,667,881 B1 3/2014 Hawbaker
8,683,725 B2 * 4/2014 Munson ..... F41A 17/38 42/6
8,714,145 B2 * 5/2014 Maeda ..... F41B 11/62 124/76
8,726,555 B2 5/2014 Carr
8,776,426 B1 * 7/2014 Symonds ..... F41A 17/38 42/49.02
8,820,211 B1 9/2014 Hawbaker
8,863,425 B2 10/2014 Lee
8,893,607 B2 * 11/2014 Audibert ..... F41A 19/14 42/69.01
8,925,232 B2 1/2015 Silveira
8,935,872 B2 1/2015 Zukowski
8,950,311 B2 * 2/2015 Emde ..... F41C 3/00 89/1.41
8,959,818 B2 2/2015 Mayerl
9,062,925 B1 * 6/2015 Viani ..... F41A 19/06
9,194,637 B2 * 11/2015 Mather ..... F41A 17/38
9,303,936 B2 * 4/2016 Toner ..... F41A 17/62
9,395,146 B2 * 7/2016 Tippmann, Jr. ..... F41B 11/722
9,404,700 B1 * 8/2016 Viani ..... F41A 19/06
9,410,758 B1 * 8/2016 Viani ..... F41A 19/06
9,410,760 B2 * 8/2016 Siddle ..... F41A 19/12
9,482,481 B2 11/2016 LaValley et al.
9,541,341 B2 1/2017 Macy
9,587,903 B2 * 3/2017 Sullivan ..... F41B 11/52
RE46,411 E * 5/2017 Chu ..... F41A 17/46
9,638,484 B1 * 5/2017 Friend ..... F41A 35/06
9,777,980 B2 * 10/2017 Heizer ..... F41A 17/56
9,803,943 B2 * 10/2017 Schafer ..... F41A 9/59
9,952,012 B2 * 4/2018 Fellows ..... F41A 19/14
9,952,013 B2 * 4/2018 Fellows ..... F41A 17/74
9,989,327 B2 * 6/2018 Horch ..... F41A 19/10
10,001,332 B1 * 6/2018 Friend ..... F41A 35/06
10,001,335 B2 * 6/2018 Patterson ..... F41A 17/56
10,101,102 B2 10/2018 Eitan et al.
10,107,580 B2 * 10/2018 Fellows ..... F41A 17/46
10,393,461 B2 * 8/2019 Fellows ..... F41A 19/12
10,401,102 B1 9/2019 Carroll
10,641,571 B2 * 5/2020 Quinn ..... F41A 17/38
10,739,095 B2 8/2020 Underwood et al.
10,801,795 B2 * 10/2020 Lipowski ..... F41A 19/10
10,845,147 B2 * 11/2020 Fellows ..... F41A 19/45
10,912,292 B1 2/2021 Maggiore
11,320,221 B2 * 5/2022 Kastrun ..... F41A 3/72
2005/0132627 A1 6/2005 Wossner et al.
2008/0078284 A1 4/2008 Murello
2009/0158634 A1 * 6/2009 Bubits ..... F41A 17/22 42/70.06
2010/0229447 A1 9/2010 Metzger
2010/0287806 A1 11/2010 Marfione et al.
2011/0232148 A1 9/2011 Cain et al.
2011/0271827 A1 11/2011 Larson et al.
2012/0174454 A1 7/2012 Kallio
2012/0180354 A1 7/2012 Sullivan et al.
2014/0215880 A1 8/2014 Zukowski
2014/0311007 A1 * 10/2014 Capps ..... F41A 19/10 42/69.01
2015/0219413 A1 8/2015 Karimullah et al.
2015/0253096 A1 9/2015 Lee
2015/0267984 A1 9/2015 Kokinis et al.
2015/0292828 A1 10/2015 Nebeker et al.
2015/0308784 A1 10/2015 Cho
2015/0068092 A1 12/2015 Kallio
2015/0362274 A1 12/2015 Merlino et al.
2016/0033218 A1 2/2016 Folkestad et al.
2016/0047614 A1 2/2016 Larson, Jr.
2016/0131449 A1 5/2016 Horch
2016/0178303 A1 6/2016 Macy
2016/0178304 A1 6/2016 Geissele
2016/0187090 A1 6/2016 Mather et al.
2016/0187092 A1 6/2016 Mather et al.
2016/0377364 A1 12/2016 Santos Reis
2017/0003093 A1 1/2017 Spinner et al.
2017/0184366 A1 6/2017 Zajk et al.
2017/0268843 A1 * 9/2017 Heizer ..... F41A 3/66
2017/0328663 A1 11/2017 Fellows et al.
2018/0112944 A1 4/2018 Underwood et al.
2019/0271524 A1 9/2019 Khoshnood
2021/0247157 A1 8/2021 Lesenfants
2021/0270551 A1 9/2021 Underwood et al.
2021/0348867 A1 11/2021 Reynolds et al.
2022/0034615 A1 * 2/2022 Fellows ..... F41A 19/24

(56) References Cited

U.S. PATENT DOCUMENTS

| | | | | |
|---|---|---|---|---|
| 2022/0120526 | A1* | 4/2022 | Kim | F41A 19/10 |
| 2022/0307788 | A1* | 9/2022 | Bender | F41A 17/46 |
| 2022/0357122 | A1* | 11/2022 | Niswander | F41A 19/10 |
| 2022/0364812 | A1* | 11/2022 | Fellows | F41C 3/00 |

* cited by examiner

FIREARM OPERATING SYSTEM

CROSS REFERENCE TO RELATED APPLICATIONS

This application is a continuation of U.S. patent application Ser. No. 16/920,258 ("the '258 application") filed Jul. 2, 2020, which is a continuation of U.S. patent application Ser. No. 15/365,523 ("the '523 application") filed Nov. 30, 2016, which is related to and claims priority benefit from U.S. Provisional Application No. 62/261,566 ("the '566 application"), filed on Dec. 1, 2015, entitled FIREARM OPERATING SYSTEM. The '258 application, the '523 application and the '566 application are each hereby incorporated in their entirety by this reference.

FIELD OF THE INVENTION

The field of the invention relates to firearms, particularly firearms with operating systems with a central pivoting member designed to simplify functions of a firearm and/or to minimize the number of springs necessary for operating the firearm and to reduce the number of systems and components for operating the firearm while eliminating the fixed mechanical attachment between the trigger and the firing mechanism.

BACKGROUND

For more than one hundred years, many firearms particular, semi-automatic firearms) have included operating systems that rely on (1) a direct and fixed mechanical attachment between the trigger and the firing system and (2) require multiple springs to operate. In addition, many firearms have included separate/additional mechanical systems for releasing the slide and disassembling the firearm.

To simplify the firearm operating system and to increase reliability, it may be desirable to combine multiple functions into individual components of the firearm. Furthermore, it may be desirable to eliminate the direct and fixed mechanical attachment between the trigger and the firing system while simultaneously reducing the required number of springs within the operating system.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain embodiments of the present invention, a firearm operating system comprises: a housing; a central pivoting member disposed within the housing; a trigger comprising a portion disposed within the housing and a portion extending outside the housing such that the portion of the trigger within the housing comprises a hole and at least one finger that extends in a first direction from the hole; wherein, due to movement of the trigger, the at least one finger presses against the central pivoting member to cause the central pivoting member to rotate.

According to certain embodiments of the present invention, a semiautomatic handgun comprises: an upper receiver; a lower receiver, the lower receiver comprising: a grip portion; a trigger guard disposed on a forward side of the grip portion; at least one protrusion on an inner surface of the lower receiver; a central pivoting member disposed within the lower receiver; and a trigger comprising a portion disposed within the lower receiver and a portion extending outside the lower receiver such that the portion of the trigger within the lower receiver comprises a hole and at least one finger that extends in a first direction from the hole; wherein, due to movement of the trigger, the at least one finger presses against the central pivoting member to cause the central pivoting member to rotate.

According to certain embodiments of the present invention, a firearm operating system comprises: a trigger rotatable about a first hole; a hammer rotatable about a second hole; a sliding arm rotatable about a third hole; and a lever arm rotatable about a fourth hole, wherein rotation of the trigger causes a bolt to move from an open position to a closed position.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Although the illustrated embodiments shown in FIGS. 1-20B focus on semi-automatic handguns, the features, concepts, and functions described herein are also applicable (with potential necessary alterations for particular applications) to rifles, carbines, shotguns, or any other type of firearm that function as semi-automatic, automatic (including belt-fed), or any other type of action. As one additional example, a configuration for a rifle is shown in FIGS. 21-26.

Figure 1:
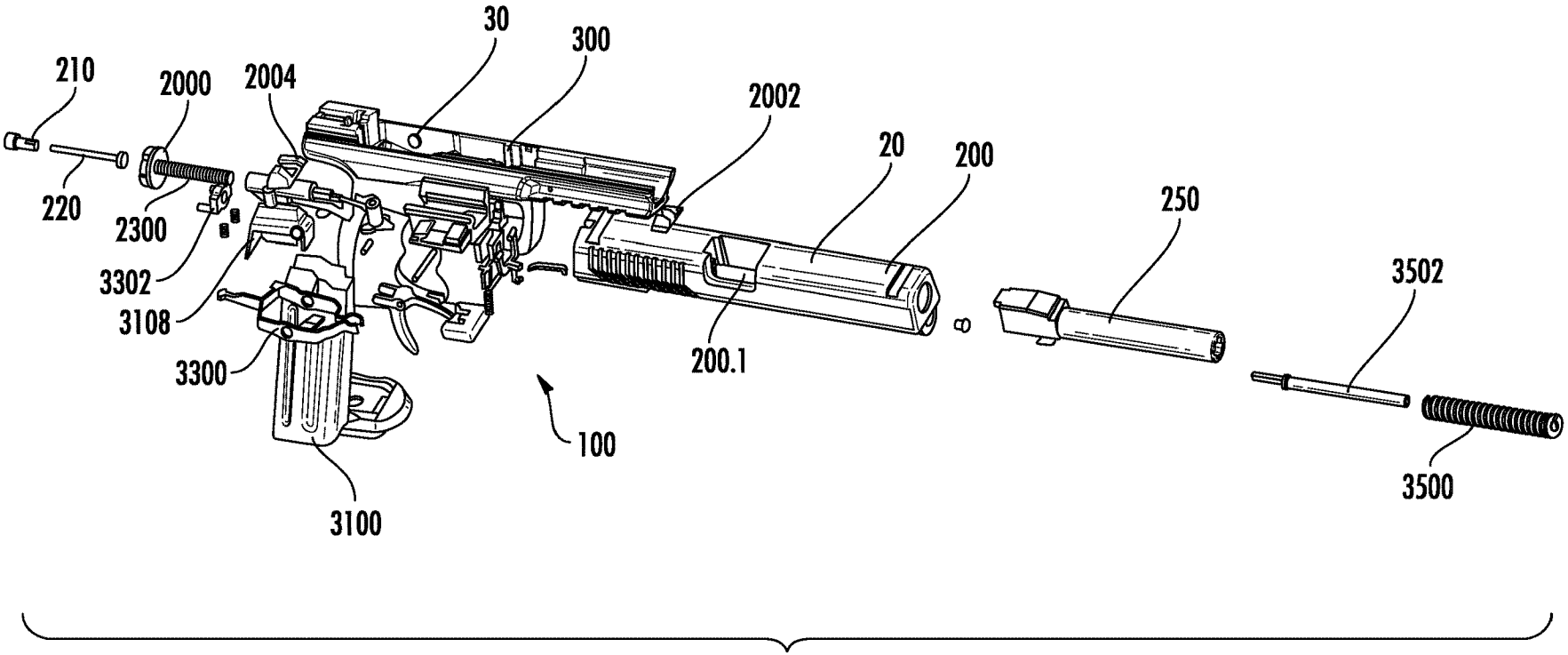
FIG. 1 is an exploded perspective view of a firearm, according to certain embodiments of the present invention.
Figure 2:
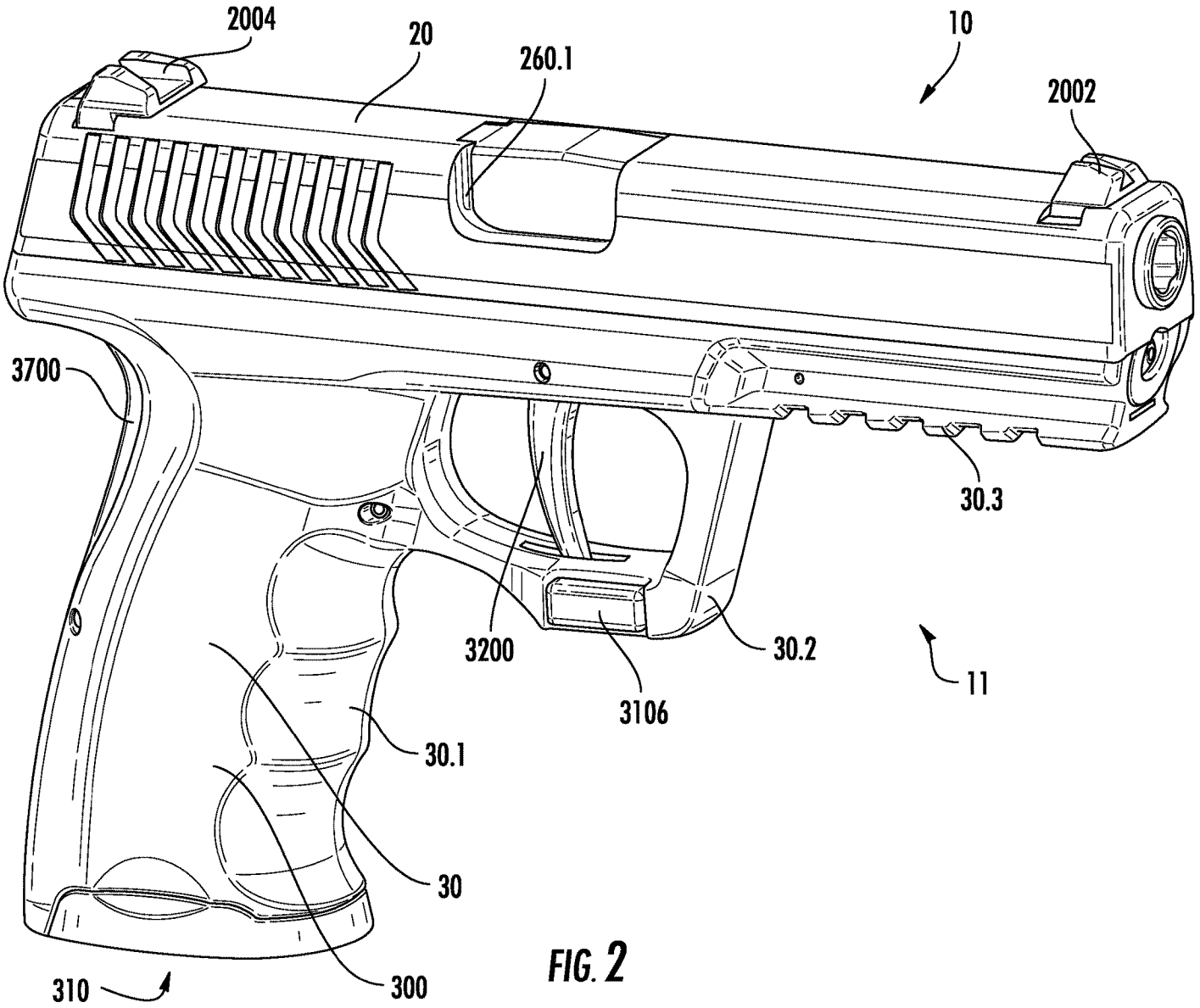
FIG. 2 is an assembled perspective view of the firearm of FIG. 1.

According to certain embodiments of the present invention, as shown in FIGS. 1 and 2, a firearm 10 comprises a housing 11 and an operating system 100. In some embodiments, the housing 11 includes an upper receiver 20 and a lower receiver 30.

Upper Receiver Components

In some embodiments, the upper receiver 20 comprises a slide assembly 200, a slide cover retainer 210, a cocked warning pin 220, a striker assembly 230, a striker relief 240, a shell extractor 260, and a barrel 250.

Figure 3:
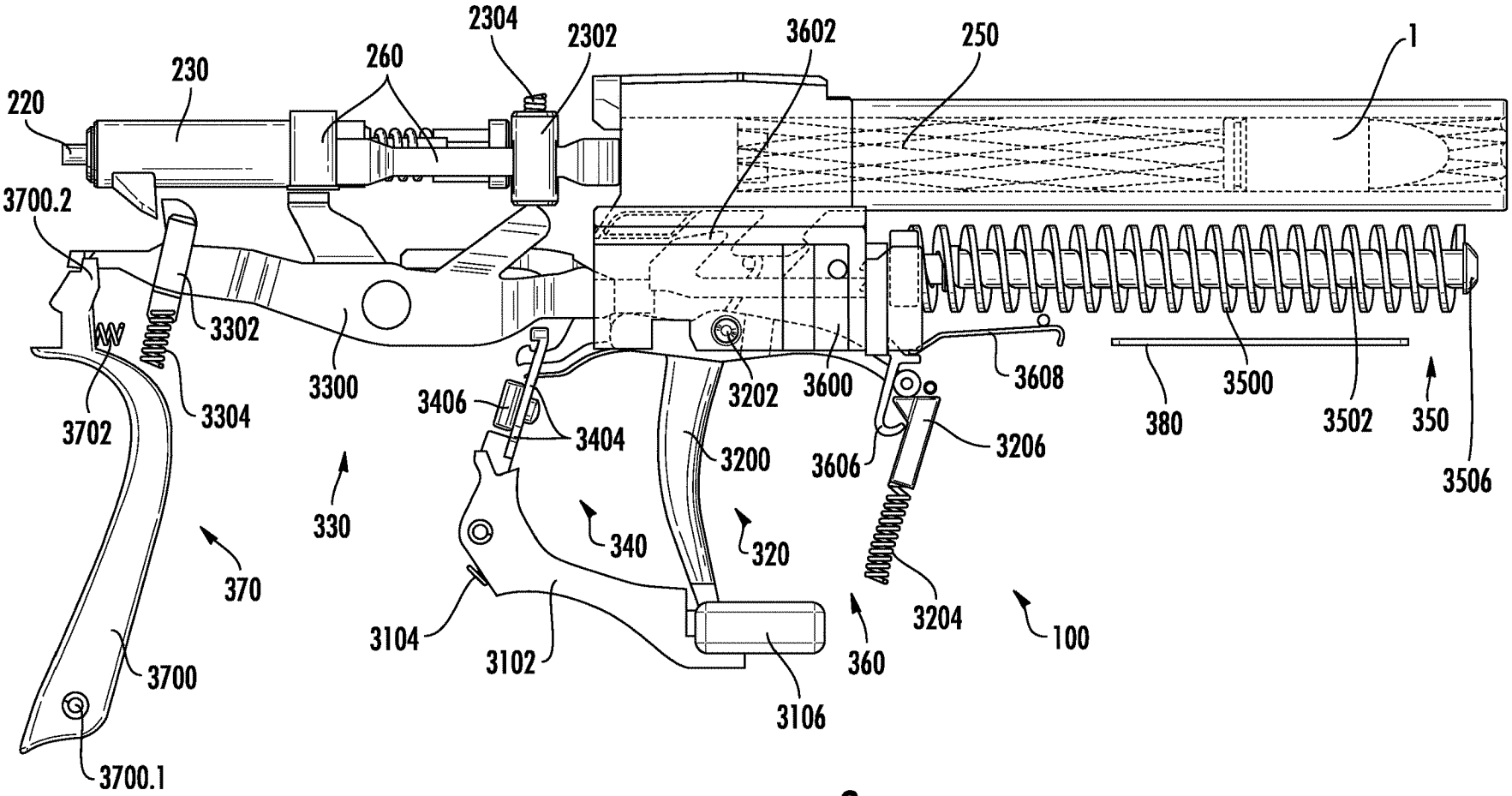
FIG. 3 is a partial right side view of the firearm of FIG. 1.
Figure 4:
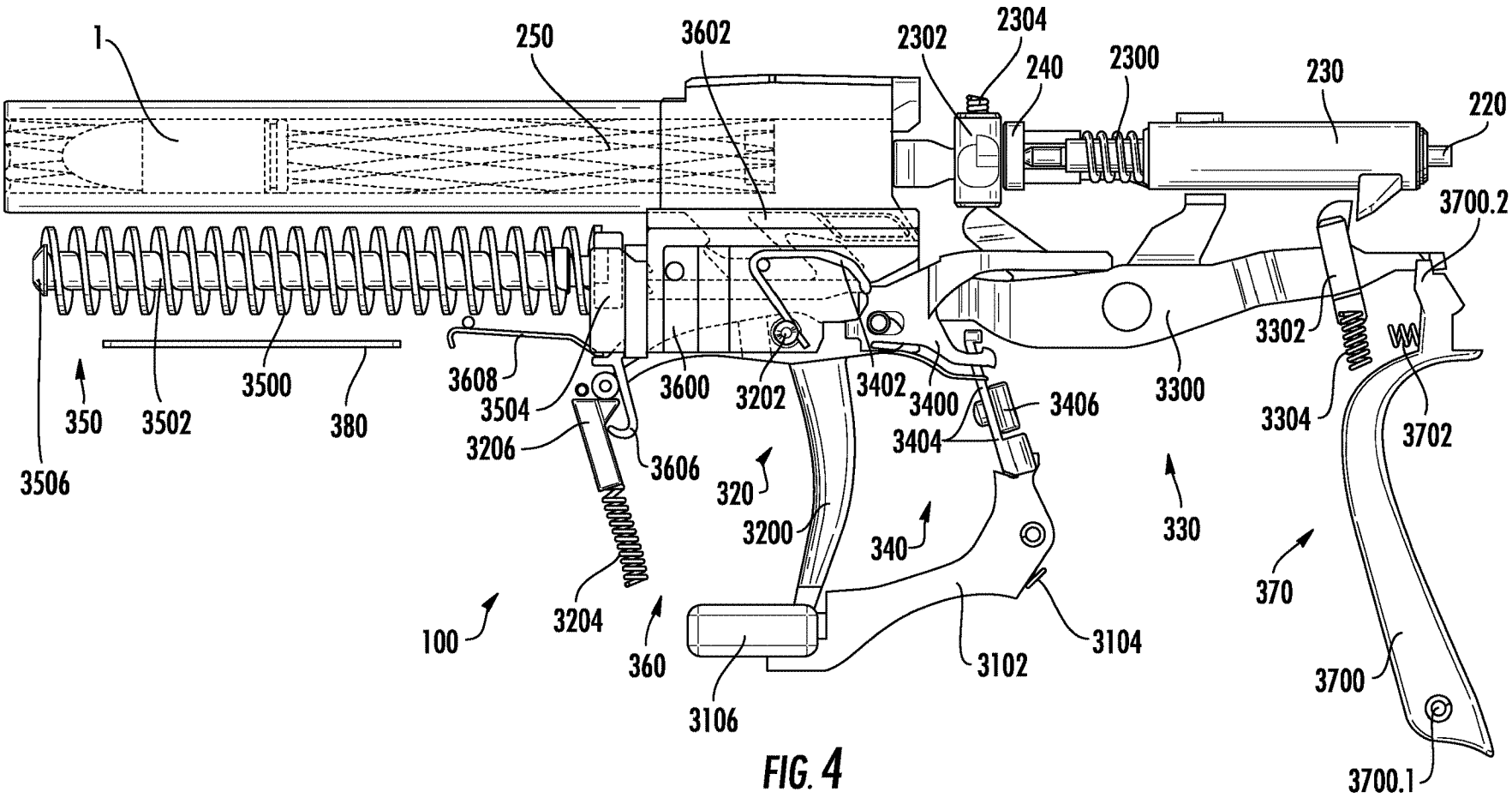
FIG. 4 is a partial left side view of the firearm of FIG. 1.
Figure 5:
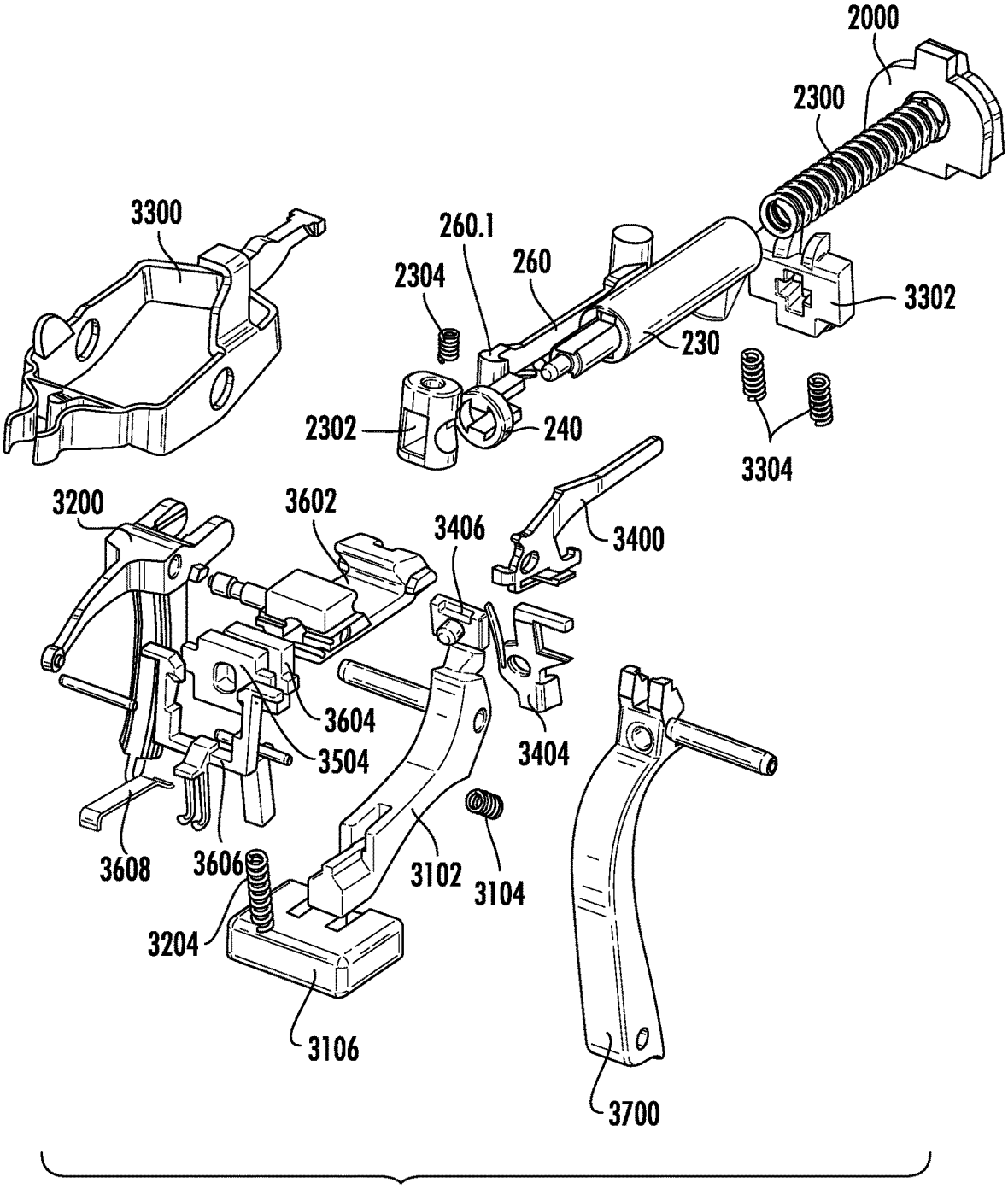
FIG. 5 is a partial exploded perspective view of the firearm of FIG. 1.
Figure 15:
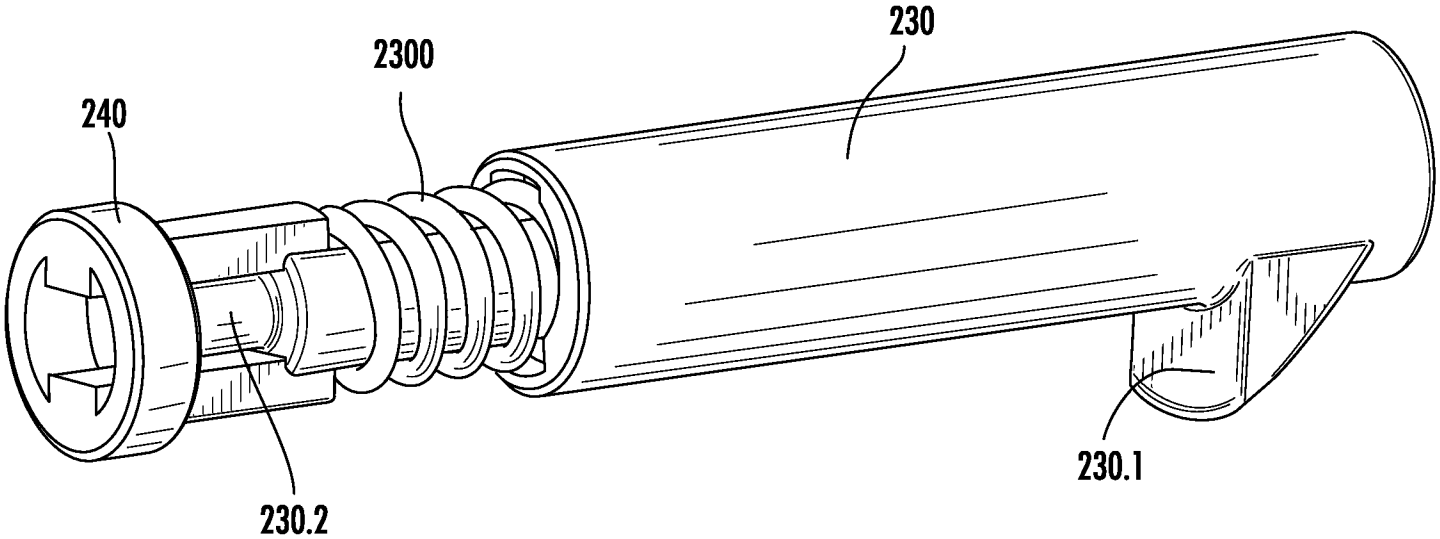
FIG. 15 is a perspective view of a striker assembly of the firearm of FIG. 1.
Figure 16A:
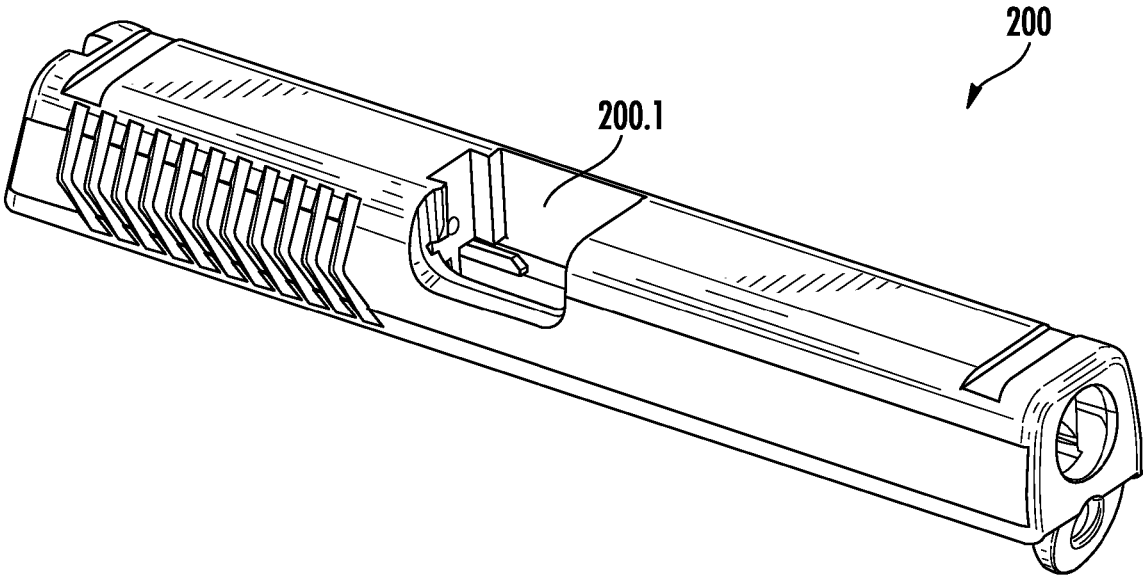
FIGS. 16A and 16B are perspective views of a slide assembly of the firearm of FIG. 1.
Figure 16B:
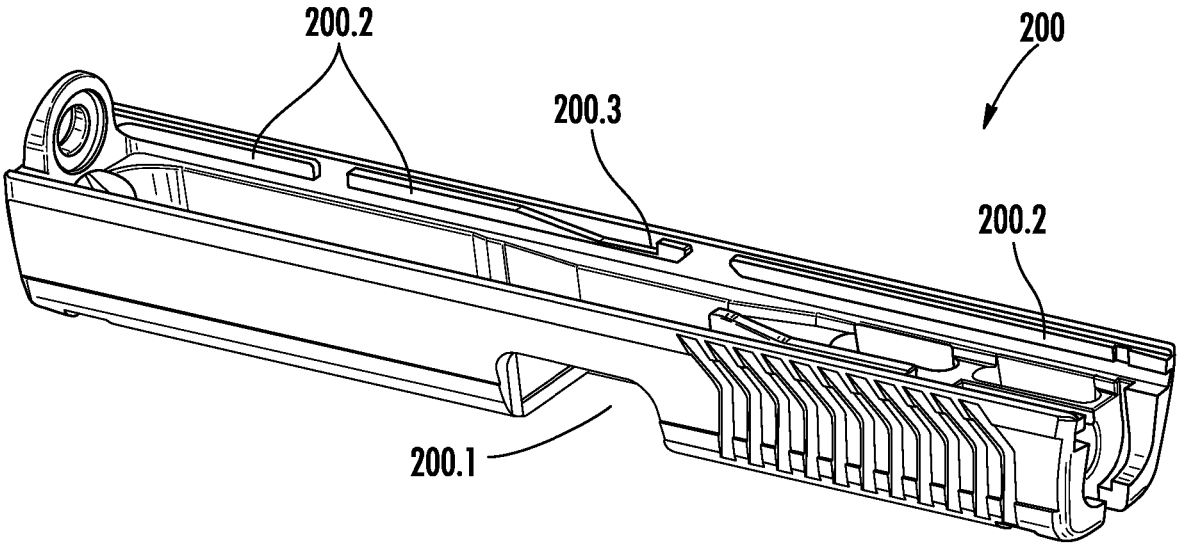

As shown in FIGS. 3, 4, and 15, the striker assembly 230 comprises a striker spring 2300, a safety striker stopper 2302, and a safety striker stopper spring 2304. The striker assembly 230 may also include a lug 230.1 and a firing pin 230.2 configured to interface with the striker release 3302.

The shell extractor 260 may include an indicator 260.1 which provides a visual signal that a cartridge 1 is loaded in the chamber.

Figure 20A:
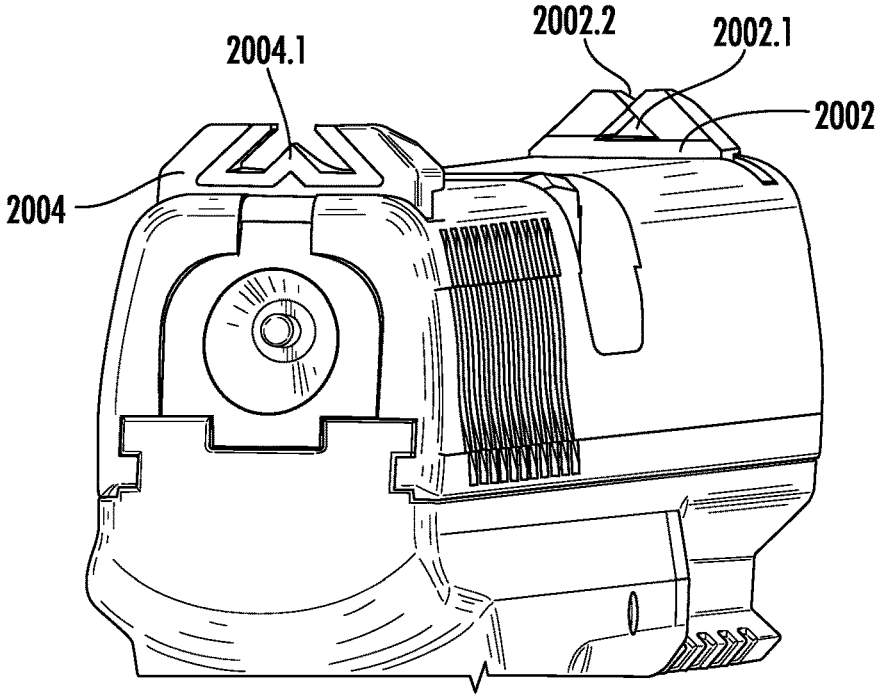
FIG. 20A is a perspective view of front and rear sights of the firearm of FIG. 1.
Figure 20B:
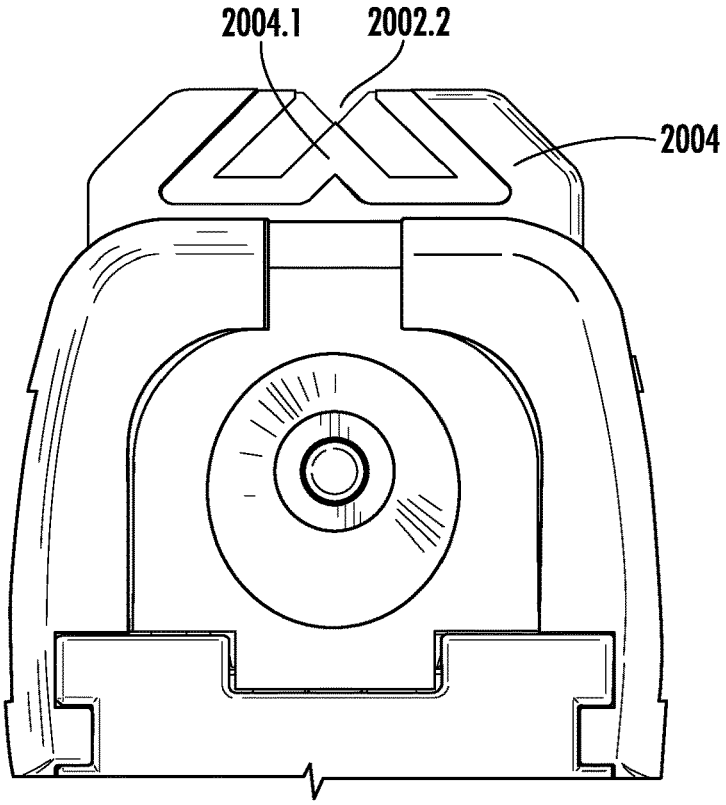
FIG. 20B is a rear view of front and rear sights of the firearm of FIG. 1.

The slide assembly 200 comprises a slide cover 2000 with a front sight 2002 and rear sight 2004 mounted thereto (see FIGS. 1, 2, 20A, and 20B). As shown in FIG. 20A, the front sight 2002 may include an internal triangular open area 2002.1. The front sight 2002 may also include an upper triangular open area 2002.2. The rear sight 2004 may include a solid triangular portion 2004.1 (see FIGS. 20A and 20B). As shown in FIG. 20B, when an operator aims the firearm 10, to ensure the sights are aligned, the solid triangular portion 2004.1 of the rear sight 2004 is aligned to cover the internal triangular open area 2002.1 of the front sight 2002. In addition, the operator can aim the firearm 10 such that the target is located within the upper triangular open area 2002.2.

Lower Receiver Components

Figure 14:
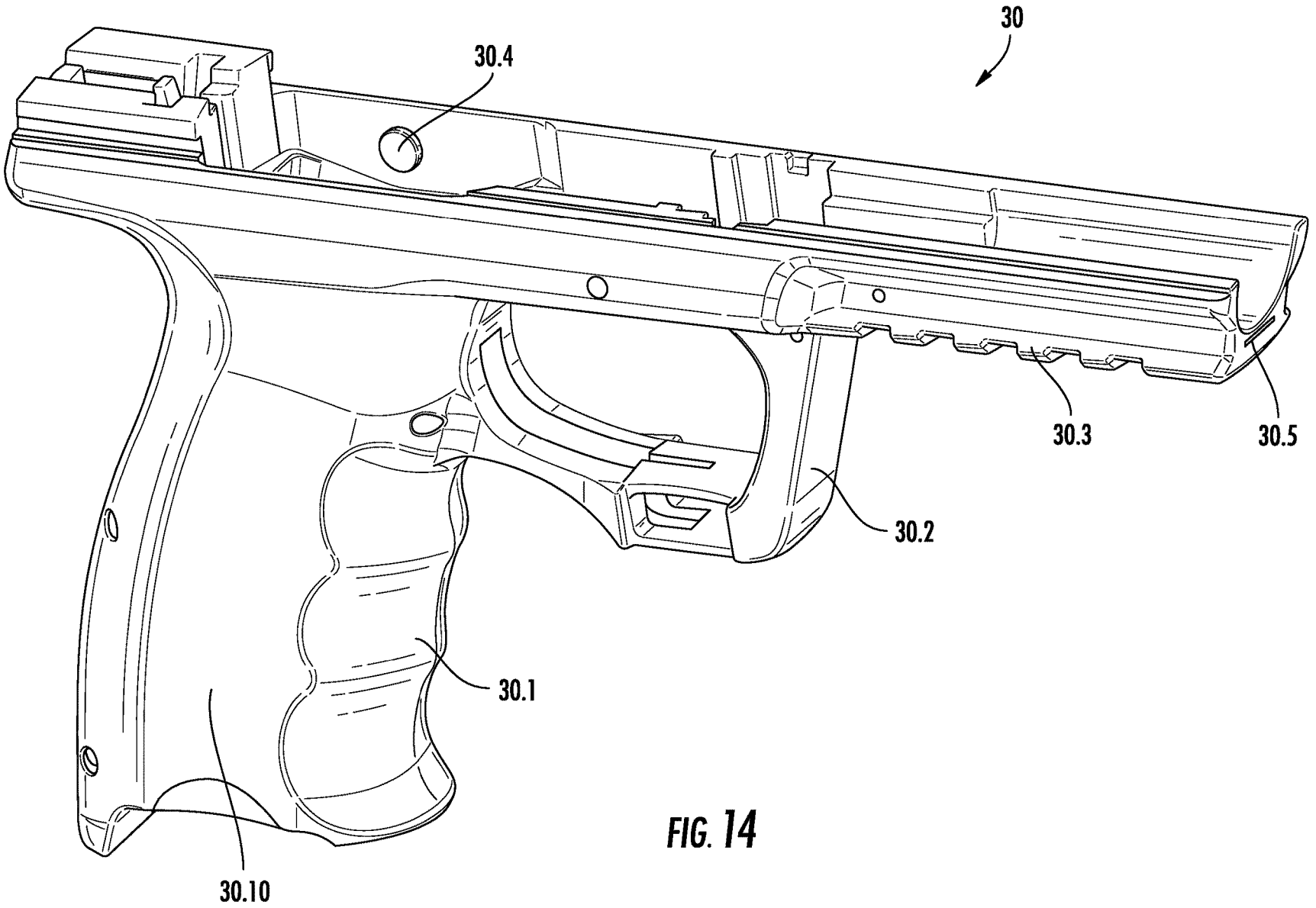
FIG. 14 is a perspective view of a lower receiver of the firearm of FIG. 1.

The lower receiver 30 comprises a frame 300, magazine assembly 310, a trigger assembly 320, a striker actuation assembly 330, a slide engagement assembly 340, a recoil assembly 350, a upper/lower connection assembly 360, back strap safety assembly 370, and a serial number plate 380 (see FIGS. 1-4). As shown in FIGS. 2 and 14, the lower receiver 30 may include a grip portion 30.1, a trigger guard 30.2, and an accessory rail 30.3 (which may be a picatinny rail or any other appropriate accessory rail). The lower receiver 30 may also include one or more protrusions 30.4 configured to interface with the holes 3300.3 of the central pivoting member 3300. In some embodiments, the one or more protrusions 30.4 are disposed approximately above the magazine well 30.10 of the lower receiver 30. The grip portion 30.1 may include a molded shape configured to provide an ergonomic shape for the operator's hands, including areas molded specifically for each finger of the dominant hand.

Figure 19A:
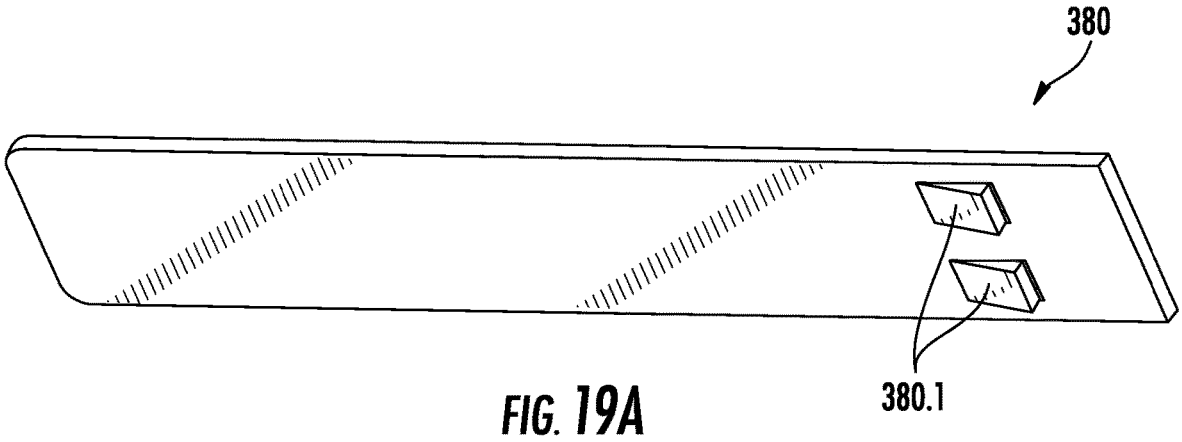
FIGS. 19A and 19B are perspective views of a serial number plate of the firearm of FIG. 1.
Figure 19B:
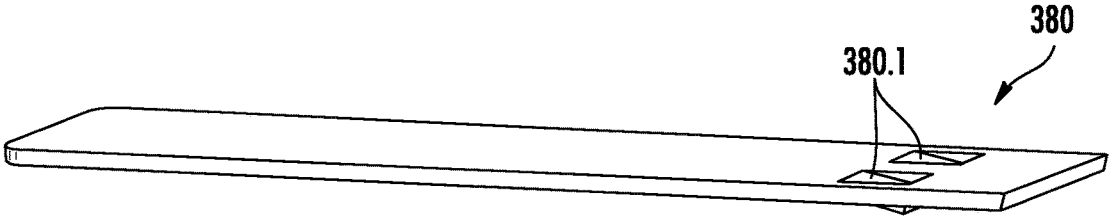
Figure 19C:
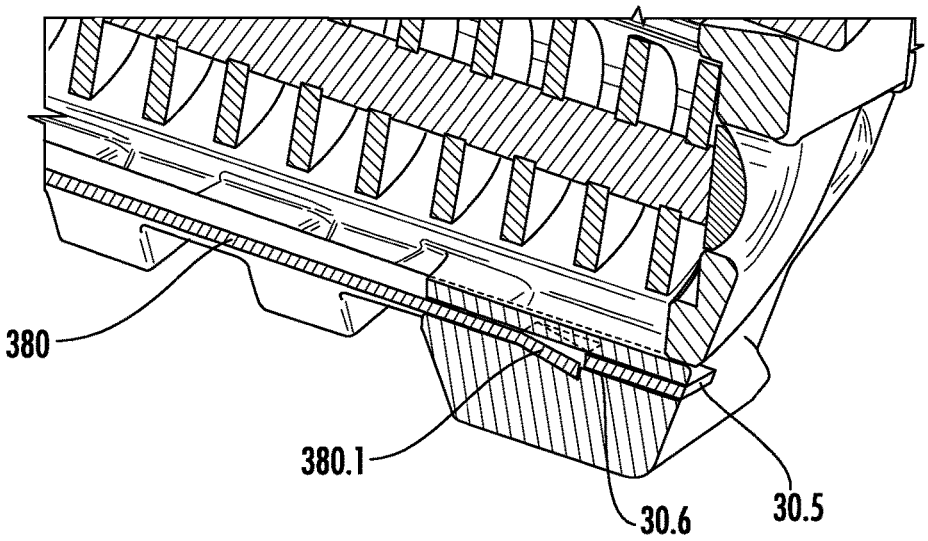
FIG. 19C is a partial cross sectional view of a serial number plate of the firearm of FIG. 1.

The lower receiver 30 may include a slot 30.5 for insertion of the serial number plate 380. Many polymer firearms include lower receivers that must be overmolded around a serial plate, which is time-consuming and inefficient. To overcome this issue, slot 30.5 includes one or more inner surfaces 30.6 that are configured to interface with the serial number plate 380. As shown in FIGS. 19A-19C, the one or more tabs 380.1 of the serial number plate 380 are biased in one direction. As one example, the tabs 380.1 illustrated in FIGS. 19A and 19B are portions of the serial number plate 380 that are permanently deformed toward the bottom of the plate. When the plate 380 is inserted into slot 30.5, the one or more tabs 380.1 may temporarily deflect and drag along the inner surface(s) 30.6. Once the plate 380 is inserted such that the one or more tabs 380.1 are within the slot 30.5, the tab(s) 380.1 engage the inner surface(s) 30.6 to permanently secure the plate 380 in position (i.e., the tab(s) 380.1 can only move inward but engage the inner surface(s) 30.6 to preclude the serial number plate 380 from moving outward). Accordingly, the serial number plate 380 may be inserted but not removed thus preventing tampering with the serial number plate 380. The engagement of the serial number plate 380 with the inner surface(s) 30.6 is equally secure for tamper resistance compared to an over-molded serial number plate 380.

The magazine assembly 310 (see FIGS. 2-5, 10A, and 10B) may comprise a magazine 3100 (which may include an engagement feature 3100.1 for securing the magazine 3100 with respect to the firearm 10), a magazine release lever 3102, magazine release spring 3104, magazine release button 3106, a follower 3108, a magazine floor plate 3110, a floor plate retainer 3112.

Figure 13A:
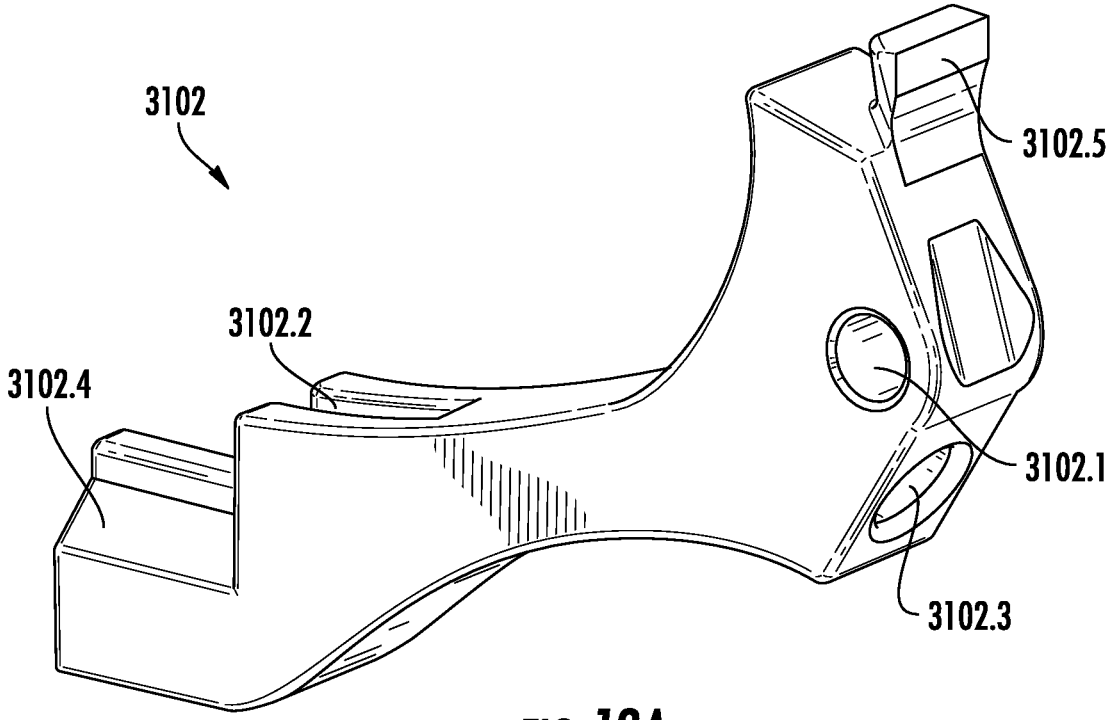
FIG. 13A is a perspective view of a magazine release lever of the firearm of FIG. 1.
Figure 13B:
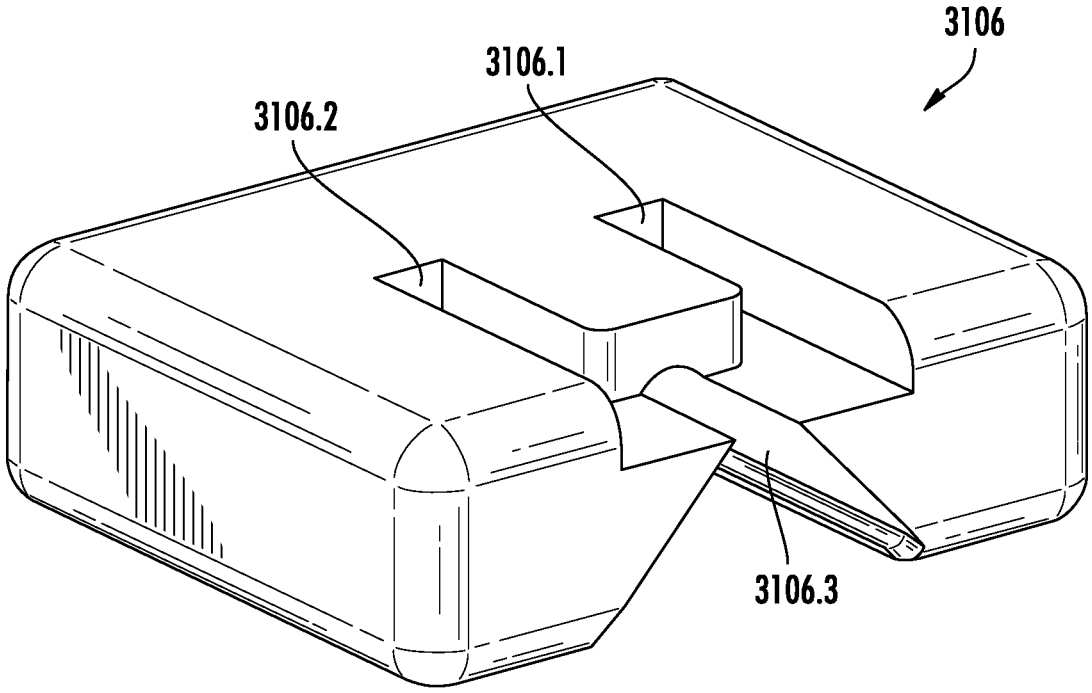
FIG. 13B is a perspective view of a magazine release button of the firearm of FIG. 1.

The magazine release lever 3102, as shown in FIG. 13A, may include a first hole 3102.1 such that the magazine release lever 3102 pivots about the first hole 3102.1. The second hole 3102.3 allows for attachment of the magazine release spring 3104 (see FIGS. 3 and 4). The slot 3102.2 is configured to interface with the tab 3200.6 of the trigger 3200 when the operator pulls the trigger 3200 to discharge the firearm or for another purpose. The magazine release lever 3102 may include one or more ramped surface(s) 3102.4 configured to interface with the ramped surface(s) 3106.3 of the magazine release button 3106. Lateral movement of the magazine release button 3106 causes the ramped surface(s) 3106.3 to bear against the ramped surface(s) 3102.4 such that the magazine release lever 3102 pivots about the first hole 3102.1 against the magazine release spring 3104. The pivoting motion of the magazine release lever 3102 disengages the retaining feature 3102.5 from the engagement feature 3100.1 of the magazine 3100 (thus releasing the magazine 3100 from the firearm 10).

The position of the magazine release button 3106 prevents the magazine 3100 from being released while the firearm 10 is holstered. This is an important consideration for law enforcement and/or military operator, where someone can approach from behind and release a loaded magazine leaving the operator with only one cartridge 1 in the chamber.

In addition to the one or more ramped surface(s) 3106.3 (described above), the magazine release button 3106 may include one or more channels configured to interface with the tab 3200.6 of the trigger 3200 to allow the operator to push the trigger 3200 forward. For example, in some embodiments, the magazine release button 3106 may include a first channel 3106.1 and a second channel 3106.2 such that the operator can push the magazine release button 3106 in a lateral direction to either side and the relevant channel will align with the slot 3102.2 of the magazine release lever 3102 and the operator may push the trigger 3200 forward into first channel 3106.1 or second channel 3106.2.

As shown in FIGS. 2-5, the trigger assembly 320 may comprise a trigger 3200, a trigger pin 3202, a trigger coil spring 3204, and a trigger coil spring pusher 3206.

Figure 8:
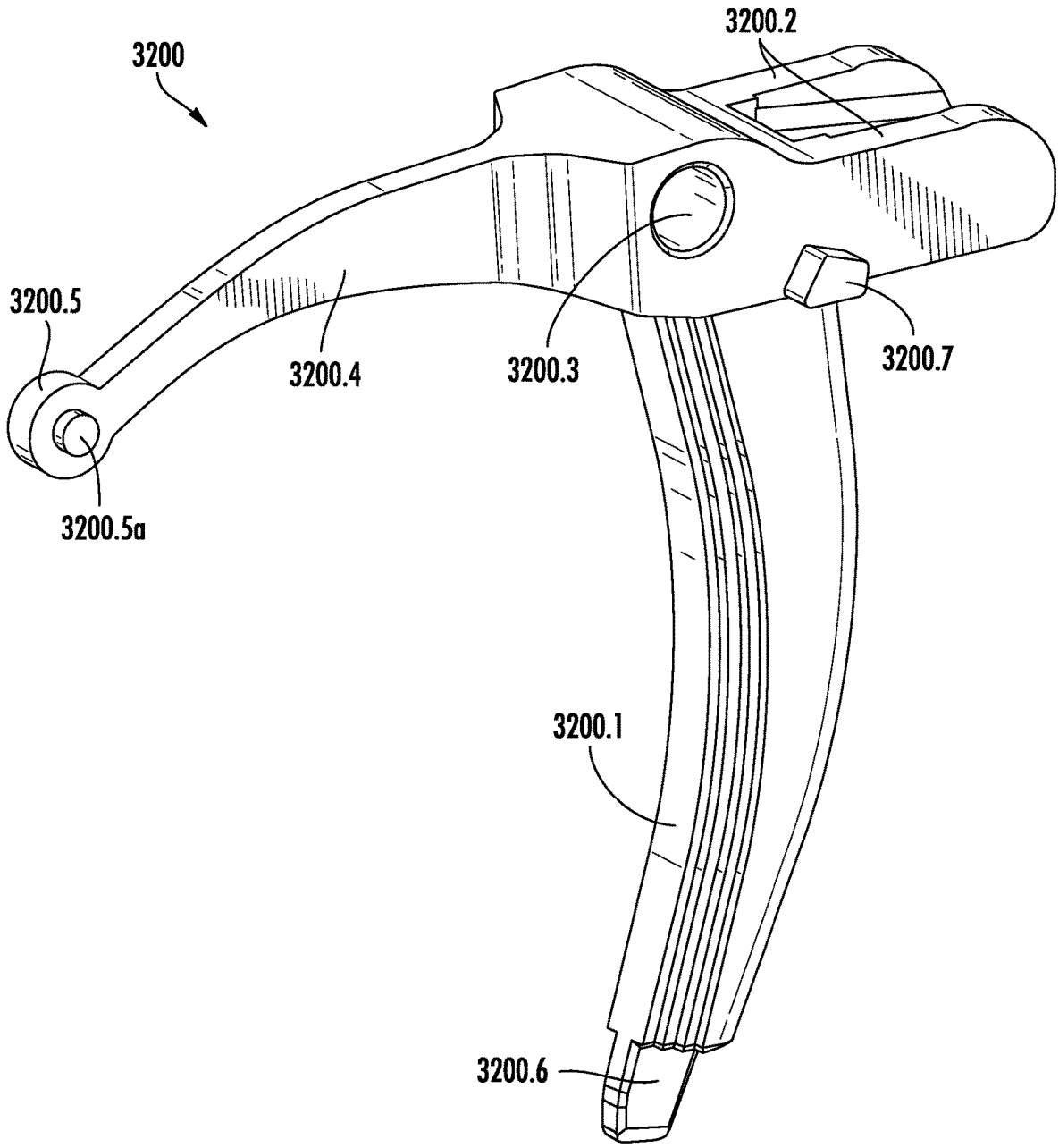
FIG. 8 is a perspective view of a trigger of the firearm of FIG. 1.

The trigger 3200, as illustrated in FIG. 8, may include a curved portion 3200.1 configured to interface with an operator's finger. The trigger 3200 may also include one or more fingers 3200.2 configured to interface with the central pivoting member 3300. In some embodiments, the one or more fingers 3200.2 are configured to interface with the one or more curved arms 3300.1 of the central pivoting member 3300. The trigger 3200 may be configured to pivot on the trigger pin 3202 (see FIGS. 3 and 4) about hole 3200.3.

The trigger 3200 may include an arm 3200.4 with a head 3200.5 and one or more protrusions 3200.5*a*. The head 3200.5 and/or the protrusion(s) 3200.5*a* may be configured to interface with one or more other components. For example, the head 3200.5 may interface with the trigger coil spring pusher 3206 (which provides a resistance due to trigger coil spring 3204). In addition, the head 3200.5 and/or the protrusion(s) 3200.5*a* may be configured to interface with the locking ring push-puller 3606 (see FIGS. 3 and 4). At the bottom of the curved portion 3200.1, the trigger 3200 may include a tab 3200.6 such that the tab 3200.6 is configured to interface with the magazine release lever 3102 (in particular, the channel 3102.2 shown in FIG. 13A) when the operator pulls the trigger 3200 to discharge the firearm 10. In some embodiments, the tab 3200.6 is configured to interface with the magazine release button 3106 (in particular, the channels 3106.1 and/or 3106.2 shown in FIG. 13B) when the operator pushes the trigger 3200 forward to disassemble the firearm 10. The protrusion 3200.7 is configured to interface with the boss 3400.7 of the slide catch 3400 (see FIGS. 4 and 7) and the one or more notches 3600.13 of the receiver rail insert 3600 (see FIGS. 4, 6A, and 6B).

The striker actuation assembly 330 comprises a central pivoting member 3300, a striker release 3302, and striker release springs 3304 (see FIGS. 3-5 and 9).

Figure 9:
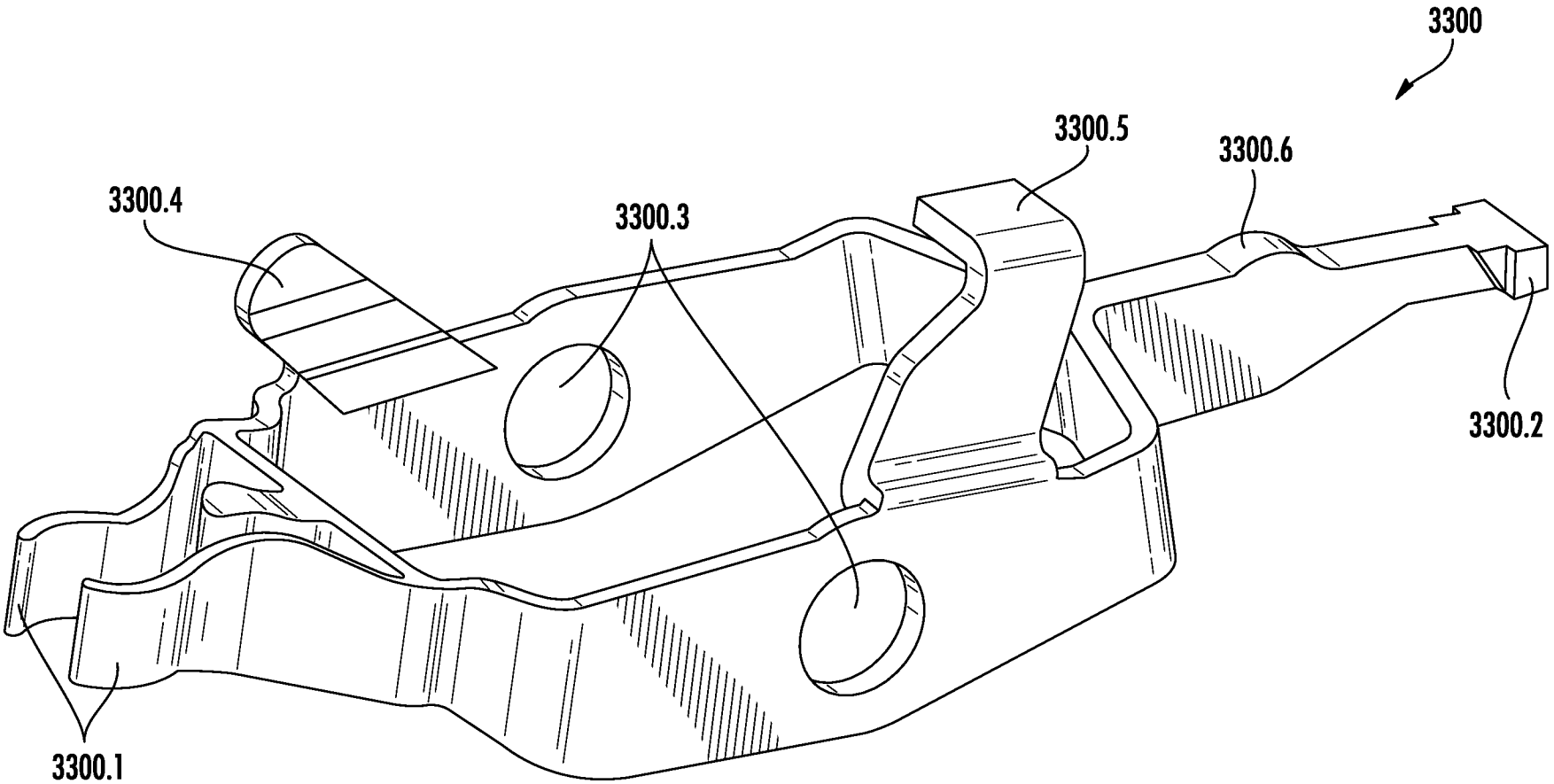
FIG. 9 is a perspective view of a central pivoting member of the firearm of FIG. 1.

The central pivoting member 3300 may be configured to pivot/rotate analogous to a see-saw. As shown in FIG. 9, the central pivoting member 3300 may include one or more curved arms 3300.1. In some embodiments, the one or more curved arms 3300.1 are located at a forward end of the central pivoting member 3300 and interface with the one or more fingers 3200.2 of the trigger 3200. At the rear end of the central pivoting member 3300 is safety portion 3300.2, which is configured to interface with the upper portion 3700.2 of the back strap safety 3700. The central pivoting member 3300 may pivot about the holes 3300.3. The holes 3300.3 may be located in the side walls of the central pivoting member 3300 approximately halfway along the length of the central pivoting member 3300. The safety finger 3300.4 may extend upward to interface with the safety striker stopper 2302, which provides resistance due to safety striker stopper spring 2304 (see FIG. 4). The ejector plate 3300.5 extends up from the central pivoting member 3300 and interfaces with the empty shell as the slide assembly 200 moves rearward with respect to the lower receiver 30 during the operating cycle such that the ejector plate 3300.5 pushes the empty shell through opening 200.1. Finally, the central pivoting member 3300 may include a striker interface feature 3300.6 that is configured to interface with the striker release 3302, which provides resistance due to the striker release springs 3304 (see FIGS. 3 and 4).

As shown in FIGS. 3-5 and 7, the slide engagement assembly 340 comprises a slide catch 3400, a slide catch spring 3402, a slide catch release 3404, and a slide catch release retainer 3406.

Figure 6A:
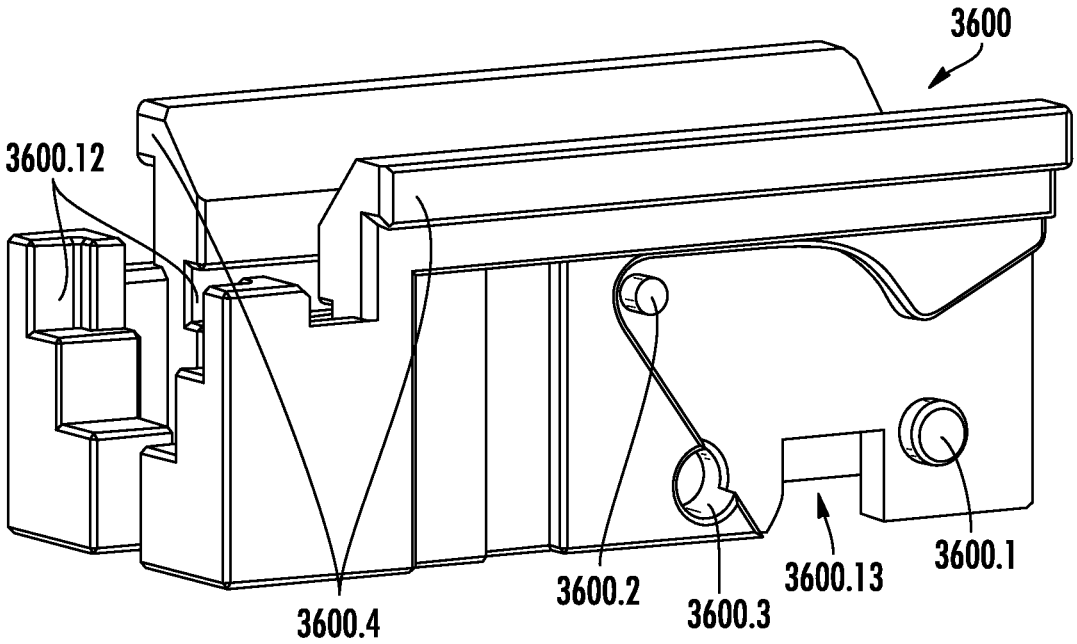
FIGS. 6A and 6B are perspective views of a receiver rail insert of the firearm of FIG. 1.
Figure 6B:
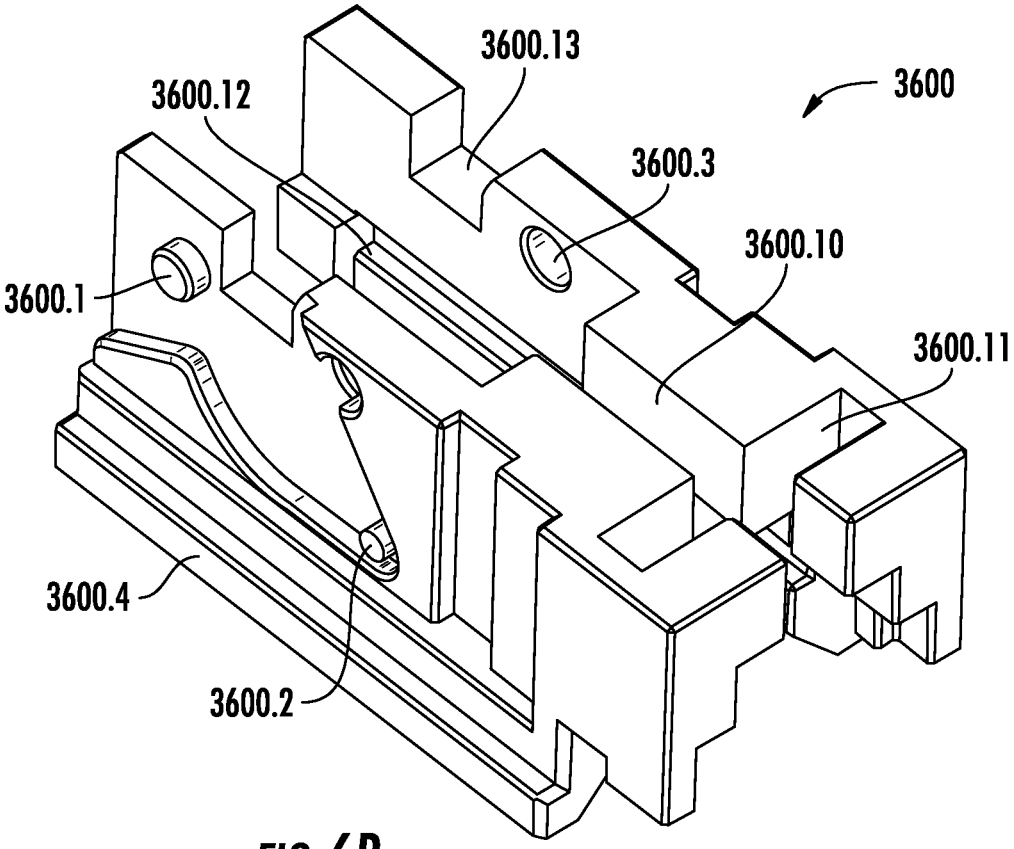
Figure 7:
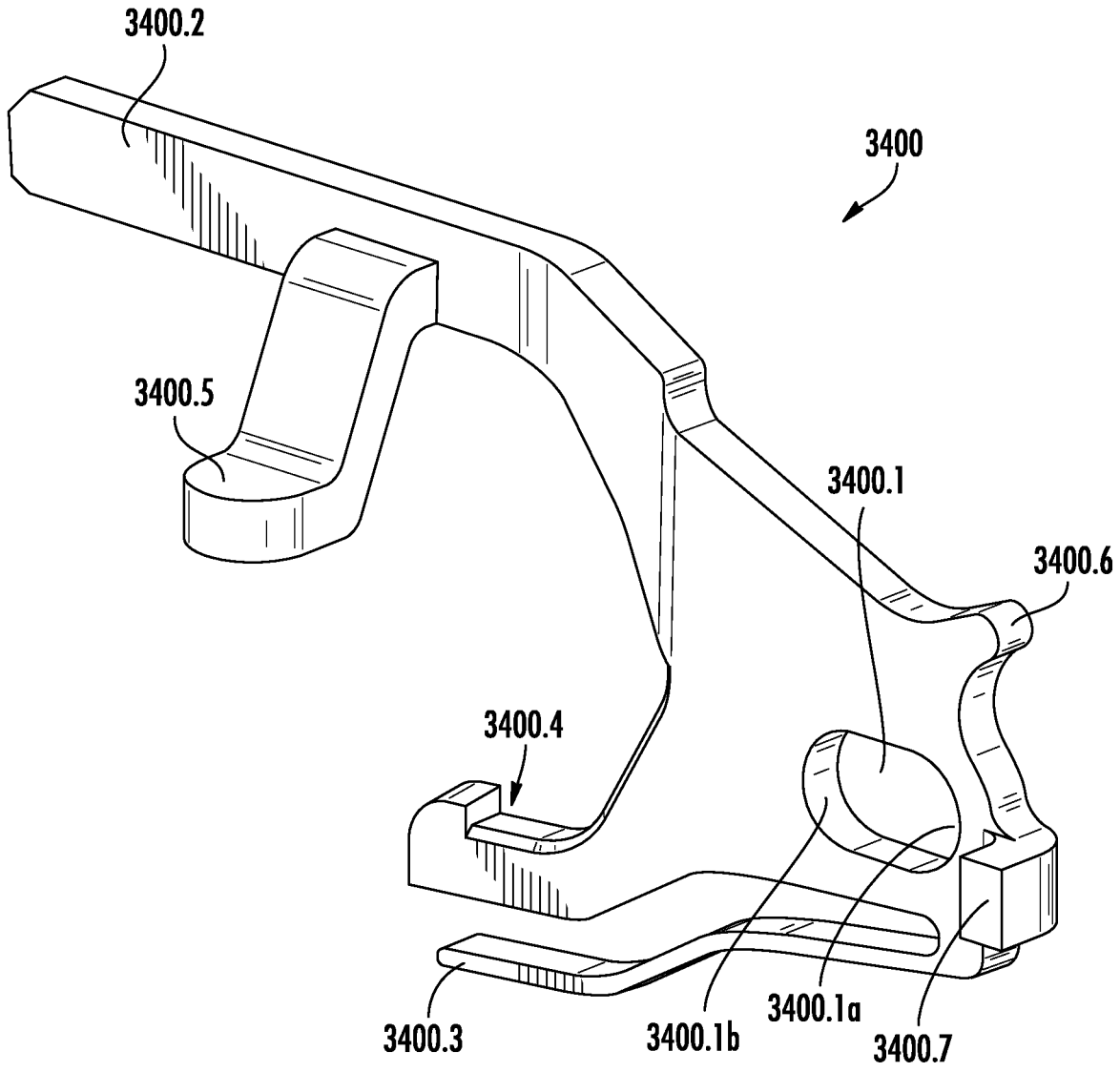
FIG. 7 is a perspective view of a slide catch of the firearm of FIG. 1.
Figure 10A:
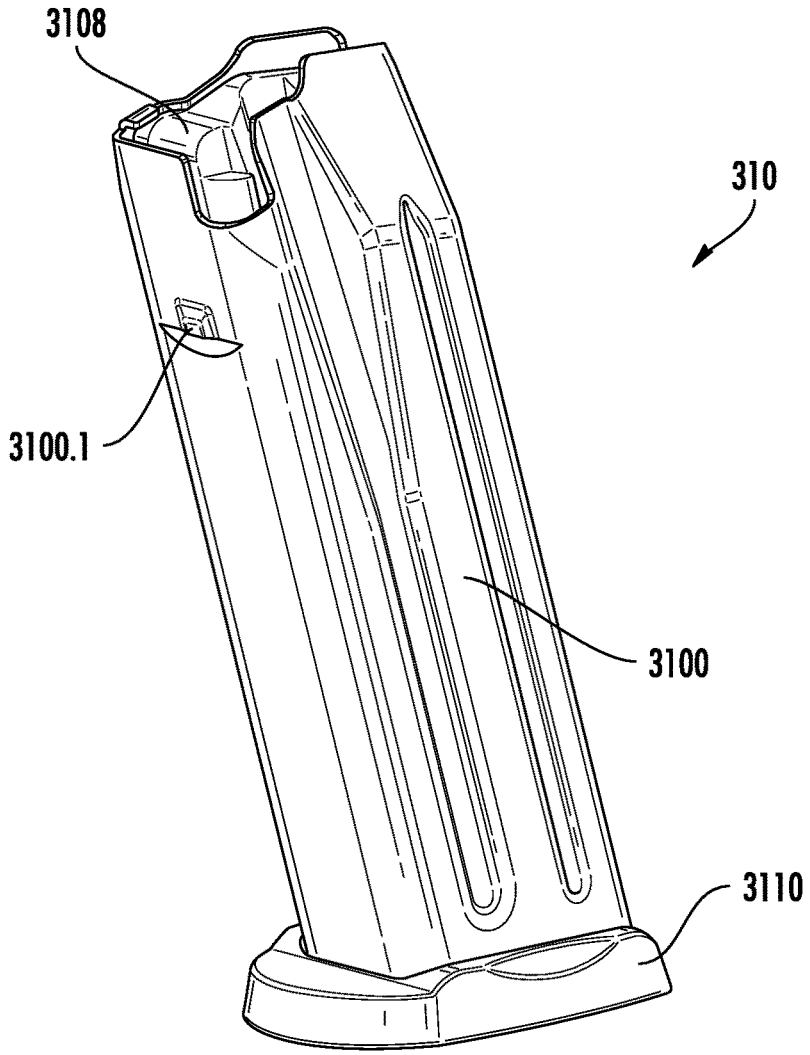
FIGS. 10A and 10B are perspective views of a magazine assembly of the firearm of FIG. 1.
Figure 10B:
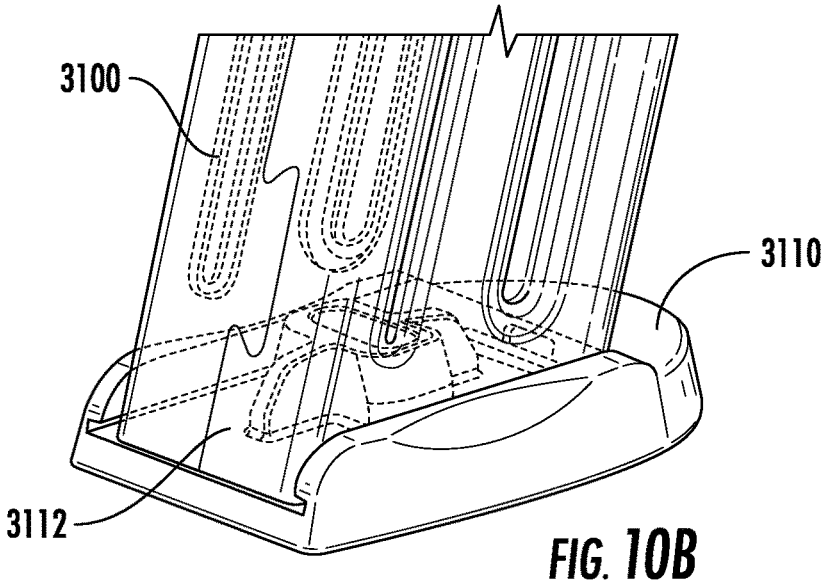

The slide catch 3400, as shown in FIG. 7, may include a slotted hole 3400.1 that interfaces with the first protrusion 3600.1 of the receiver rail insert 3600. The slotted hole 3400.1 has a first end 3400.1*a* and a second end 3400.1*b*. The slide catch 3400 may also include an upper protrusion 3400.2 configured to interface with the slide assembly 200. The slide catch 3400 may include, at its lowermost extremity, a protrusion 3400.3 configured to interface with the first ledge 3404.1 of the slide catch release 3404 (see FIGS. 4 and 12). In some embodiments, the protrusion 3400.3 may act as a spring. The notched protrusion 3400.4 is configured to interface with the second ledge 3404.2 of the slide catch release 3404 (see FIGS. 4 and 12). The slide catch 3400 may include a laterally extending arm 3400.5 configured to interface with the follower 3108, which is shown in FIG. 10A (i.e., when the magazine 3100 is empty). The front protrusion 3400.6 is configured to interface with the slide catch spring 3402. The boss 3400.7 is configured to interface with protrusion 3200.7 of the trigger 3200 (see FIGS. 4 and 8) and the one or more notches 3600.13 of the receiver rail insert 3600 (see FIGS. 4, 6A, and 6B).

The recoil assembly 350 may comprise a recoil spring 3500, a recoil spring guide rod 3502, a locking ring recoil spring holder 3504, and a socket button head cap screw 3506 (see FIGS. 3 and 4).

As shown in FIGS. 3-6B, the upper/lower connection assembly 360 comprises a receiver rail insert 3600 (shown transparent in FIGS. 3 and 4), a lock block 3602, a locking ring 3604, a locking ring push-puller 3606, and a locking ring push-puller spring 3608.

As illustrated in FIGS. 6A and 6B, the receiver rail insert 3600 includes a first protrusion 3600.1 that interfaces with the slide catch 3400 (see FIG. 4). In particular, the first protrusion is inserted into slotted hole 3400.1 (see FIG. 7).

The position of the first protrusion 3600.1 within the slotted hole 3400.1 depends of the condition/status of the firearm and will be explained in further detail below. The second protrusion 3600.2 is configured to interface with slide catch spring 3402 (see FIG. 4). The outer surfaces of the receiver rail insert 3600 may include one or more rails 3600.4 that are configured to interface with the one or more elongated protrusions 200.2 of the slide assembly 200 (see FIG. 16B). For example, in some embodiments, the elongated protrusions 200.2 slide along the underside (as shown in FIG. 6A) of the one or more rails 3600.4.

The receiver rail insert 3600 may include a hole 3600.3 configured to interface with the trigger pin 3202 (see FIGS. 3 and 4) such that the trigger 3200 pivots on the trigger pin 3202 about hole 3200.3 (see FIG. 8). Further, based on the location of the hole 3600.3, part of the trigger 3200 is disposed within the receiver rail insert 3600 in a longitudinal channel 3600.10 (see FIG. 6B). The receiver rail insert 3600 may also include a lateral channel 3600.11 (see FIG. 6B) configured to interface with the locking ring push-puller 3606 (see FIGS. 3 and 4). To interface with the lock block 3602, the receiver rail insert 3600 may include one or more side wall channels 3600.12 (see FIGS. 6A and 6B). In particular, the protrusions 3602.1-3602.4 (see FIG. 11) are configured to interface with the one or more side wall channels 3600.12. Finally, the receiver rail insert 3600 may include one or more notches 3600.13 that are configured to allow for the movement of and to interface with protrusion 3200.7 of the trigger 3200 (see FIGS. 4 and 8) and boss 3400.7 of the slide catch 3400 (see FIGS. 4 and 7).

Figure 11:
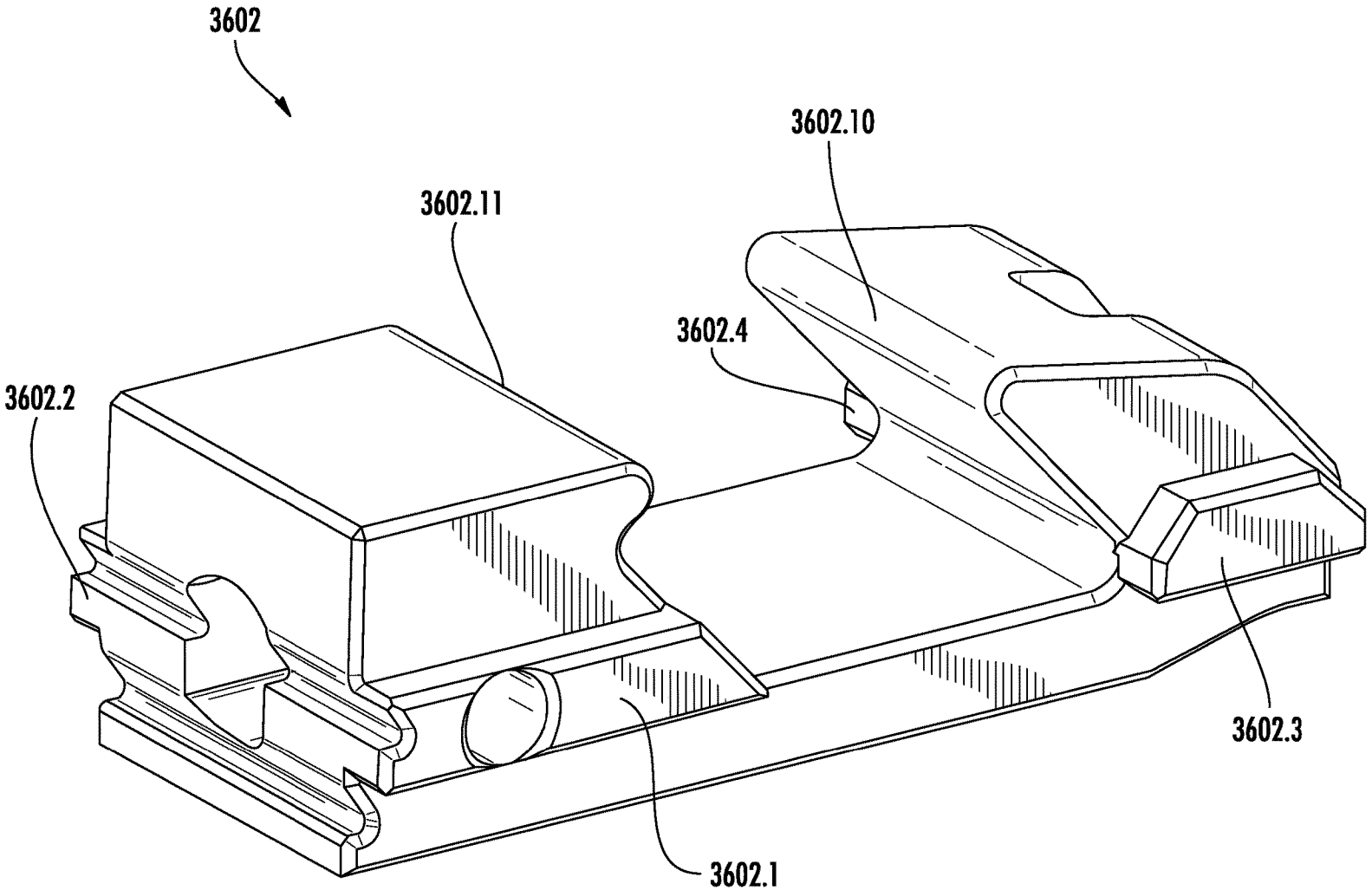
FIG. 11 is a perspective view of a slide block of the firearm of FIG. 1.
Figure 12:
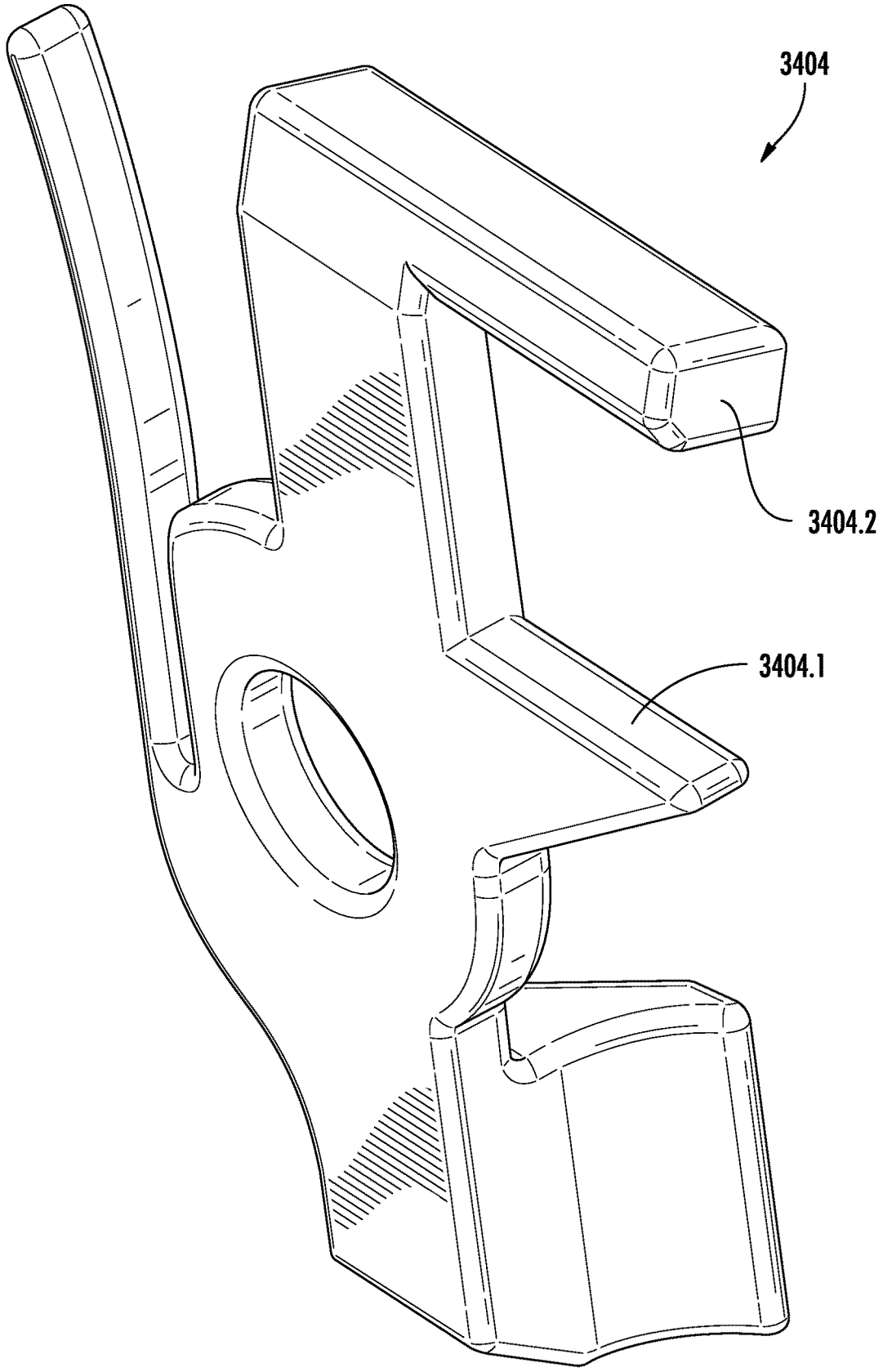
FIG. 12 is a perspective view of a slide catch release of the firearm of FIG. 1.
Figure 18:
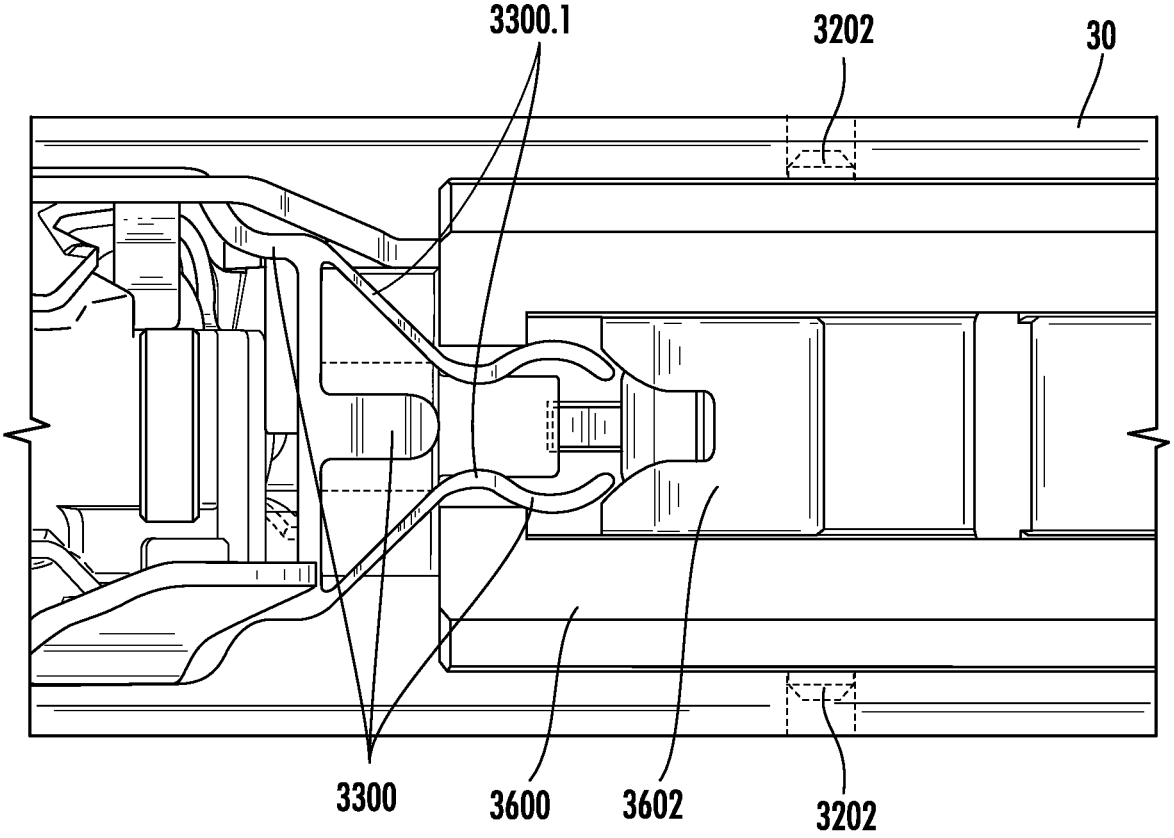
FIG. 18 is a partial top view of the firearm of FIG. 1.

As shown in FIGS. 11 and 18, the lock block 3602 (in addition to protrusions 3602.1-3602.4) may include a first interface feature 3602.10 configured to interface with the barrel 250 during rearward movement of the barrel 250 during the operating cycle. The lock block 3602 may also include a second interface feature 3602.11 configured to interface with the barrel 250 during forward movement of the barrel during disassembly of the firearm 10.

The back strap safety assembly 370 comprises a back strap safety 3700 and a back strap spring 3702. As shown in FIGS. 3 and 4, the back strap safety 3700 includes a pivot 3700.1 disposed near a bottom of the safety 3700 and an upper portion 3700.2 that interfaces with the rear portion of the central pivoting member 3300 (see safety portion 3300.2 in FIG. 9). Many firearms include a safety that pivots about an axis near the top of the safety. However, the location of pivot 3700.1 improves ergonomics by aligning the movement of the back strap safety 3700 with the movement of the thumb of operator's dominant hand. Furthermore, moving the pivot 3700.1 toward the bottom of the firearm 10 minimizes gaps and holes for dirt/water intrusion near the firearm 10 mechanism.

One-Piece Striker Design

In some embodiments, the firearm 10 includes a one-piece construction for the central pivoting member 3300, which allows (1) the ejector plate 3300.5 and (2) the safety finger 3300.4 (which controls the safety striker stopper 2302) to be mounted onto the central pivoting member 3300 (where both components normally have to be mounted to the frame). The central pivoting member 3300 reduces the number of required components which simplifies manufacturing and assembly. In addition, the central pivoting member 3300 increases reliability and simplifies maintenance due to fewer moving parts and fewer interfaces between moving parts. The direct bearing or direct contact interface between the central pivoting member 3300 and the trigger 3200 and with the striker release 3302 allows the firearm 10 to fire with all springs removed except for the striker spring 2300. Although multiple springs are illustrated and described (e.g., recoil spring 3500, striker release springs 3304, trigger coil spring 3204, safety striker stopper spring 2304, magazine release spring 3104, slide catch spring 3402, back strap spring 3702, locking ring push-puller spring 3608, etc.), all springs other than striker spring 2300 are included for comfort, convenience, and/or ergonomic reasons. Accordingly, to maximize reliability and capability, the firearm 10 can be fired with a single spring (the striker spring 2300) installed. The operating system 100 automatically resets itself (even without springs) because the barrel 250 (when moving rearward following discharge of the firearm 10) contacts the upper surface of the central pivoting member 3300 (at or near the two curved arms 3300.1). In some embodiments, the rearward movement of the lock block 3602 is dampened by the inward deflection of the two curved arms 3300.1 of the central pivoting member 3300 (see FIG. 18).

Decoupling Design Between Trigger and Central Pivoting Member

As shown in FIGS. 3 and 4, the firearm 10 may be configured such that the trigger is decoupled from the central pivoting member 3300, which is contrary to conventional firearms, where the trigger has a fixed mechanical attachment to the firing mechanism. For firearm 10, when the trigger 3200 is going to be used for other functions, the lock block 3602 is designed to pinch the two curved arms 3300.1 of the central pivoting member 3300 together so that the trigger 3200 cannot come into contact with the central pivoting member 3300. The trigger 3200 is configured to (1) fire the firearm 10, (2) disassemble the firearm 10, and (3) release the slide assembly 200 of the firearm 10.

Magazine Release Button Positioned in Trigger Guard

As shown in FIGS. 3 and 4, the magazine release button 3106 is disposed as part of the trigger guard 30.2. In some embodiments, the magazine release button 3106 is disposed underneath and forward of the trigger 3200 (i.e., the center of the magazine release button 3106 is closer to the front of the firearm 10 than any part of the curved portion 3200.1 of the trigger 3200). The position of magazine release button 3106 is particularly advantageous because an operator can move a finger from the trigger 3200 to the magazine release button 3106 without substantial movement or hand repositioning. As a result, an operator may quickly and efficiently perform reloading operations. The magazine release button 3106 is also designed to perform numerous functions, which are also described below.

(1) Releasing the Magazine

The magazine release button 3106 is positioned forward of the lower tip of the trigger 3200, and slides laterally (left or right) to release the magazine 3100 (i.e., the magazine release button 3106 is ambidextrous). Lateral movement of the magazine release button 3106 causes the ramped surface (s) 3106.3 to bear against the ramped surface(s) 3102.4 (of the magazine release lever 3102) such that the magazine release lever 3102 pivots about the first hole 3102.1 against the magazine release spring 3104. The pivoting motion of the magazine release lever 3102 disengages the retaining feature 3102.5 from the engagement feature 3100.1 of the magazine (thus releasing the magazine 3100 from the firearm 10).

(2) Facilitating Disassembly of the Firearm

The operator can push the magazine release button 3106 in a lateral direction to either side and the relevant channel (first channel 3106.1 or second channel 3106.2) will align with the slot 3102.2 of the magazine release lever 3102 and the operator may push the trigger 3200 forward into first channel 3106.1 or second channel 3106.2. The disassembly process is described in greater detail below in the context of the functions of the trigger 3200.

(3) Securing Slide in Retracted Position

When an operator presses the magazine release button 3106 in a lateral direction, the operator may hold the magazine release button 3106 in an offset position. In the offset position, the magazine release button 3106 causes the magazine release lever 3102 to pivot such that the magazine release lever 3102 presses against the lower portion of the slide catch release 3404. The slide catch release 3404 in turn presses on the protrusion 3400.3 of the slide catch 3400 such that the upper protrusion 3400.2 of the slide catch 3400 is positioned to engage and hold the slide assembly 200 in an open/retracted position (when the operator pulls the slide assembly 200 into the open position). In particular, in some embodiments, the upper protrusion 3400.2 of the slide catch 3400 engages notch 200.3 of the slide assembly 200 (see FIG. 16B).

Multiple Trigger Functions

FIGS. 3 and 4 show the default position of the trigger 3200. The trigger 3200 is configured to pivot about trigger pin 3202 in both directions (i.e., such that the lower end of the trigger 3200 moves toward the grip 30.1 of the firearm 10 or the lower end of the trigger 3200 may move toward the accessory rail 30.3 of the firearm 10).

(1) Discharging the Firearm

To discharge the firearm 10, the operator must engage (and hold) the back strap safety 3700 by pushing the upper portion 3700.2 toward the grip 30.1 (rotating about the pivot 3700.1). If the operator does not engage the back strap safety 3700, the safety portion 3300.2 will be constrained such that the central pivoting member 3300 will be precluded from rotating. Assuming a cartridge 1 is loaded in the chamber and the back strap safety 3700 is engaged, the operator may pull the trigger 3200 such that the bottom end of the trigger 3200 moves toward the grip 30.1. Movement of the trigger 3200 presses the one or more fingers 3200.2 (of the trigger 3200) against the one or more curved arms 3300.1 (of the central pivoting member 3300). The resulting rotation of the central pivoting member 3300 causes both the (a) safety finger 3300.4 to move upward to interface with the safety striker stopper 2302 and the (b) striker release 3302 to move downward to disengage from lug 230.1 of striker assembly 230. Once the striker release 3302 is disengaged from lug 230.1, the striker spring 2300 causes the firing pin to strike the cartridge 1.

(2) Disassembling the Firearm

Figure 17A:
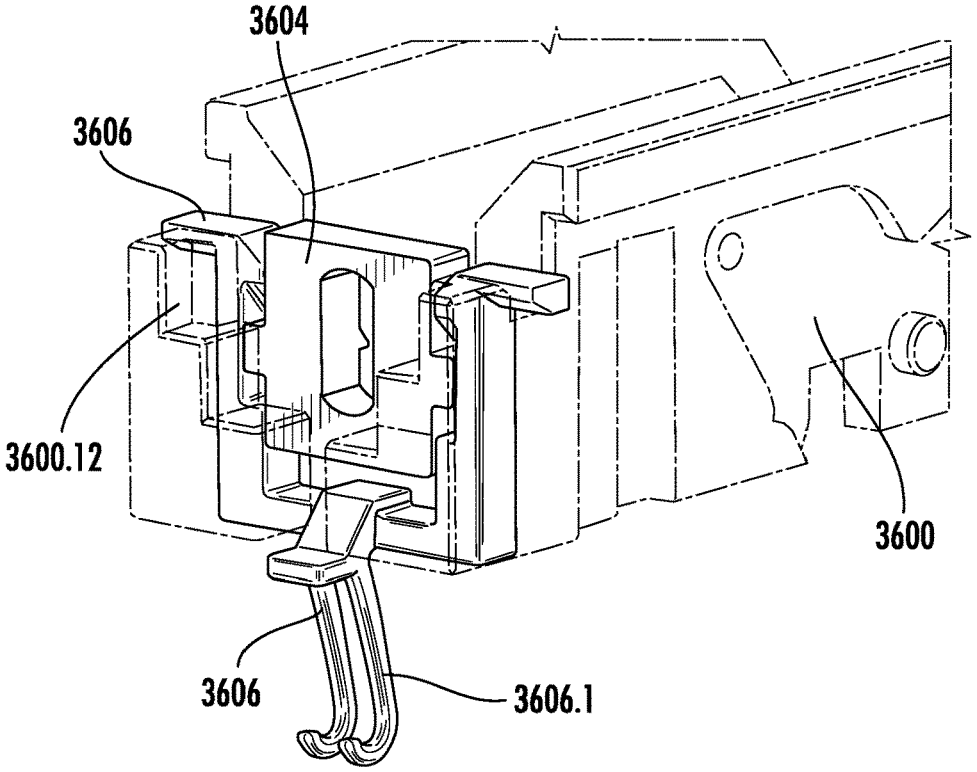
FIGS. 17A and 17B are perspective views of two states of a locking ring and a locking ring push-puller of the firearm of FIG. 1.
Figure 17B:
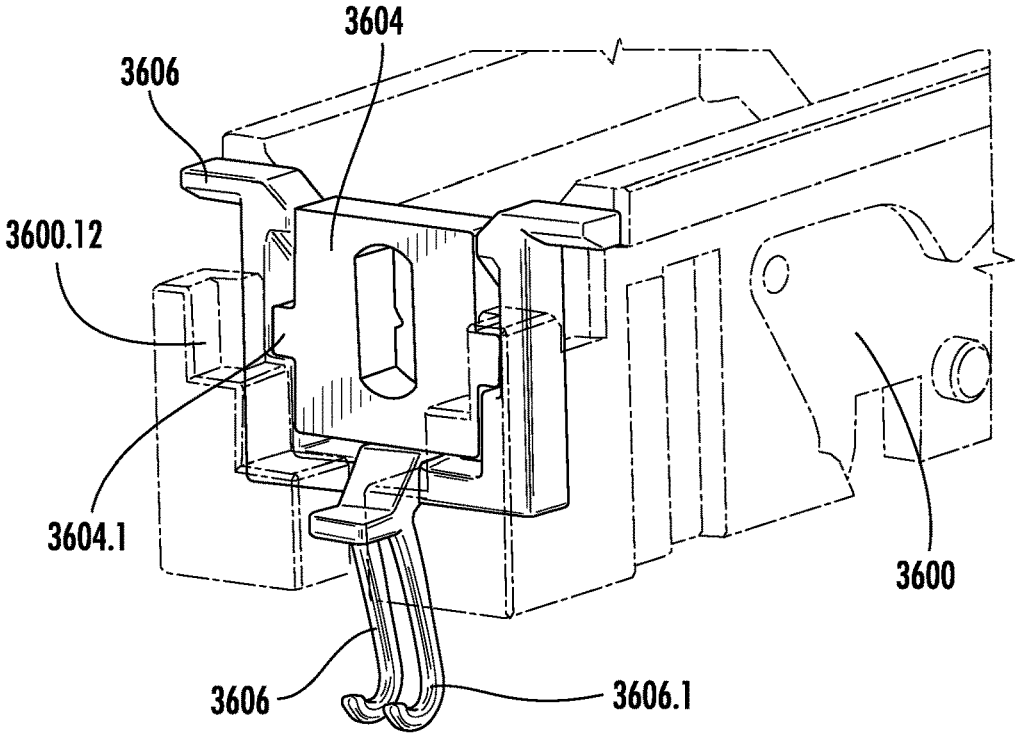

As discussed above, when the magazine release button 3106 is pushed in a lateral direction to either side, in addition to releasing the magazine 3100, the relevant channel (first channel 3106.1 or second channel 3106.2) aligns with the slot 3102.2 of the magazine release lever 3102, and the operator may push the trigger 3200 forward into first channel 3106.1 or second channel 3106.2 (such that the lower end of the trigger 3200 moves toward the accessory rail 30.3 of the firearm 10). Rotating the trigger 3200 such that the lower end of the trigger 3200 moves toward the accessory rail 30.3 causes the head 3200.5 to press upward against the locking ring push-puller 3606. The locking ring push-puller 3606 and the locking ring 3604 (including tabs 3604.1) are disposed in the lateral channel 3600.11 of the receiver rail insert 3600 (see FIG. 6B). FIG. 17A shows the arrangement of the locking ring push-puller 3606 and the locking ring 3604 before moving upward. As shown in FIG. 17B, the upward movement of the locking ring push-puller 3606 through lateral channel 3600.11 (see FIG. 6B) causes the locking ring 3604 to move upward such that tabs 3604.1 are aligned with the side wall channels 3600.12.

In most configurations (including the arrangement shown in FIG. 17A) the lock block 3602 is precluded from sliding out of the front of the receiver rail insert 3600 by the locking ring 3604. However, when the tabs 3604.1 of the locking ring 3604 are aligned with the side wall channels 3600.12 in the disassembly position (as shown in FIG. 17B) due to the movement of the locking ring push-puller 3606, the lock block 3602 is allowed to move through the end of the receiver rail insert 3600. The barrel 250 is secured to the lock block 3602 (via first interface feature 3602.10 and/or second interface feature 3602.11). Accordingly, when the trigger 3200 pushes the locking ring push-puller 3606 upward as described above, the lock block 3602, the barrel 250, and the slide assembly 200 can be removed together (sliding toward the front of the firearm 10).

As described above, the firearm 10 can be fired with a single spring (the striker spring 2300) installed. The operating system 100 automatically resets itself (even without springs) because the barrel 250 (when moving rearward following discharge of the firearm 10) contacts the upper surface of the central pivoting member 3300 (at or near the two curved arms 3300.1). In some embodiments, to avoid a situation where, immediately after discharge, the firearm 10 is in condition for disassembly, the trigger 3200 includes one or more protrusions 3200.5*a* (see FIG. 8) configured to engage one or more hooks 3606.1 of the locking ring push-puller 3606 (see FIGS. 17A and 17B). When the operator pulls the trigger 3200 (such that the bottom end of the trigger 3200 moves toward the grip 30.1), the protrusion (s) 3200.5*a* engage the hook(s) 3606.1 thus preventing the locking ring push-puller 3606 (and the locking ring 3604) from moving upward toward the disassembly position (as shown in FIG. 17B).

(3) Releasing the Slide

Unlike many semi-automatic firearms, where the slide has to be released using separate button and/or through the use of a sling shot method, the trigger 3200 may also operate to release the slide assembly 200. For example, when the slide assembly 200 is retracted or pulled back, the operator may pull the trigger 3200 such that the bottom end of the trigger 3200 moves toward the grip 30.1 to release or close the slide assembly 200. For example, an operator may want to release the slide assembly 200 after inserting a loaded magazine 3100 into the firearm 10.

The slide assembly 200 can be retracted due to discharging the firearm 10 or may be manually retracted. To hold the slide assembly 200 in the retracted position, the upper protrusion 3400.2 of the slide catch 3400 (see FIG. 7) is pushed up to engage the notch 200.3 of the slide assembly 200 (see FIG. 16B). FIG. 4 shows the typical position of the slide catch 3400 where the upper protrusion 3400.2 is not raised to engage the notch 200.3 of the slide assembly 200. Due to slide catch spring 3402 pressing on the front protrusion 3400.6, the slide catch 3400 is disposed such that the first protrusion 3600.1 (of the receiver rail insert 3600) contacts the first end 3400.1*a* of the slotted hole 3400.1. There are at least two different ways to raise the upper protrusion 3400.2 of the slide catch 3400. As described above, the operator may manually raise the upper protrusion 3400.2 by pressing and holding the magazine release button 3106 in a lateral direction. In addition, the upper protrusion 3400.2 will automatically raise due to the presence of an empty magazine 3100 in the firearm 10. In an empty magazine 3100, the follower 3108 is pushed to the top of the magazine 3100 (see FIG. 10A) by a magazine spring (not illustrated). When the follower 3108 is disposed at the top of the magazine 3100 (i.e., the magazine 3100 is empty) and the magazine 3100 is in the firearm 10, the follower 3108 presses against the laterally extending arm 3400.5 of the slide catch 3400 such that the upper protrusion 3400.2 is raised to engage the notch 200.3 of the slide assembly 200.

When the upper protrusion 3400.2 is raised (due to an empty magazine 3100 or due to the operator pressing the magazine release button 3106), the slide assembly 200 can be held in the retracted position (i.e., the upper protrusion 3400.2 engages the notch 200.3). When the upper protrusion 3400.2 engages the notch 200.3, the slide assembly 200 (due to recoil spring 3500) pushes the slide catch 3400 forward (toward the trigger 3200) such that the first protrusion 3600.1 (of the receiver rail insert 3600) contacts the second end 3400.1*b* of the slotted hole 3400.1. When the slide catch 3400 is located in the forward-biased position (first protrusion 3600.1 contacting the second end 3400.1*b*), the boss 3400.7 of the slide catch 3400 is disposed adjacent to the protrusion 3200.7 of the trigger 3200. To release the slide assembly 200, the operator can pull the trigger 3200 (such that the bottom end of the trigger 3200 moves toward the grip 30.1) causing the protrusion 3200.7 to push the boss 3400.7 upward such that the slide catch 3400 pivots about first protrusion 3600.1 and the upper protrusion 3400.2 disengages from the notch 200.3. As the slide assembly 200 releases (upper protrusion 3400.2 disengages from the notch 200.3) and moves forward, the slide catch spring 3402 presses against the front protrusion 3400.6 to push the slide catch 3400 back to its original position (i.e., where the first protrusion 3600.1 contacts the first end 3400.1*a*).

Rifle Configuration

In some embodiments, an operating system 500 is arranged in a receiver 50 and includes a trigger 5200, a hammer 5300, and a disconnector 5400. In certain embodiments, the operating system 500 also includes a bolt release 5100, a lever arm 5500, a sliding arm 5600, a safety 5700, and/or a magazine release 5800.

Although the illustrated embodiments in FIGS. 21-26 focus on semi-automatic firearms and, in particular, AR-15 variant (civilian) or M16/M4 (military) firearms, the features, concepts, and functions described herein are also applicable (with potential necessary alterations for particular applications) to other assault rifles, rifles, carbines, shotguns, or any other type of firearm.

Figure 21:
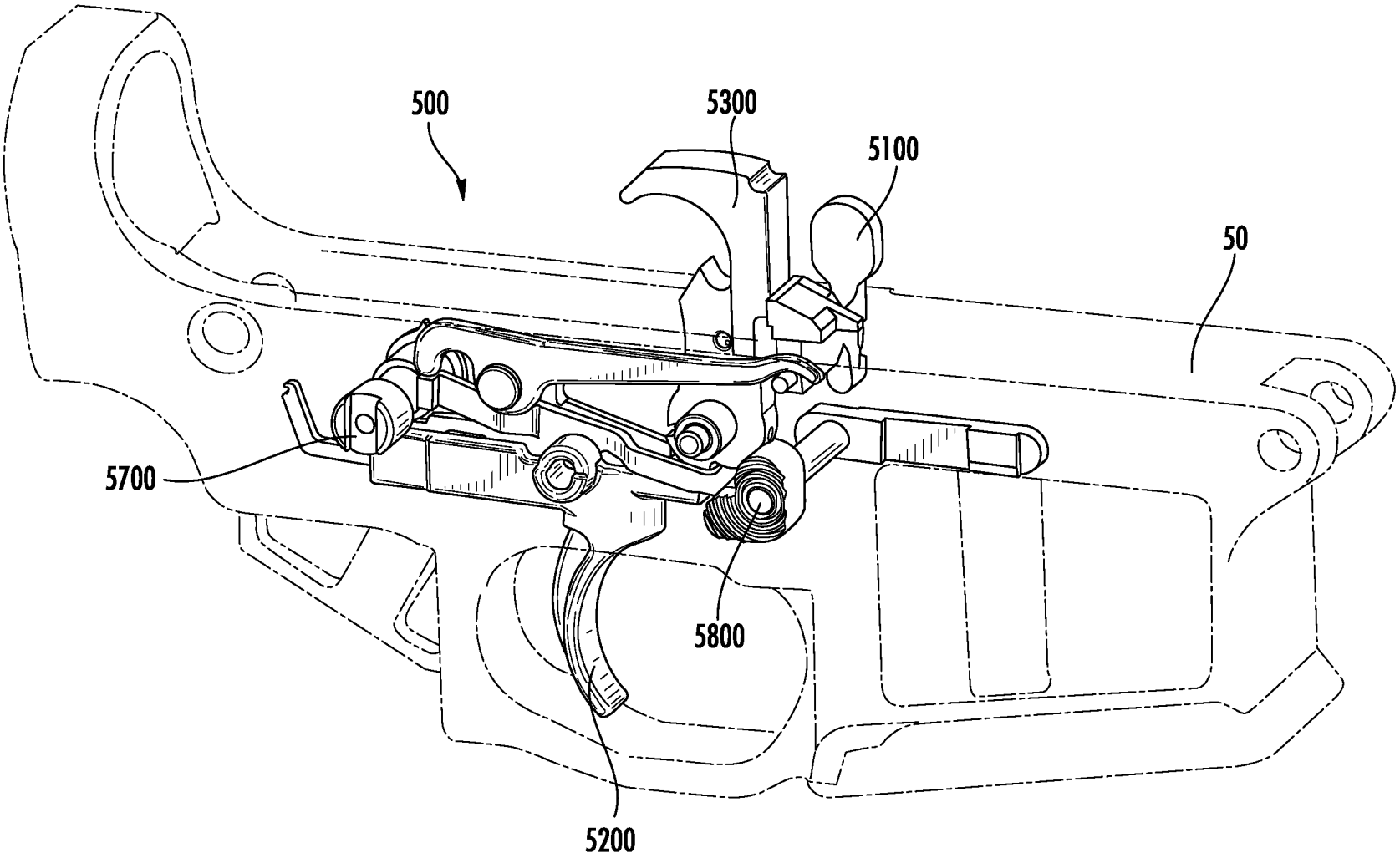
FIG. 21 is a partial perspective view of a firearm, according to certain embodiments of the present invention.
Figure 22:
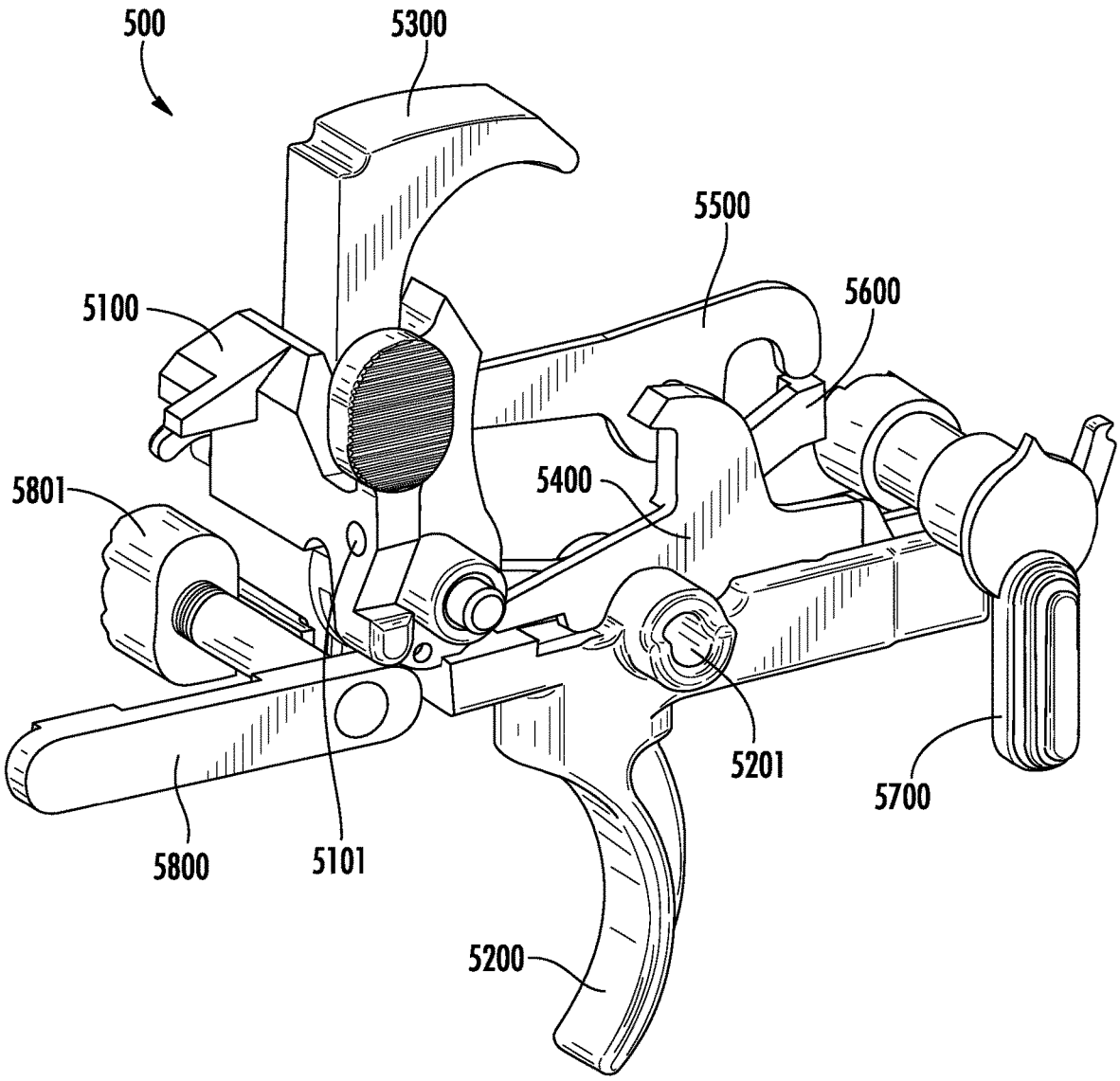
FIG. 22 is a partial perspective left side view of the firearm of FIG. 21.
Figure 23:
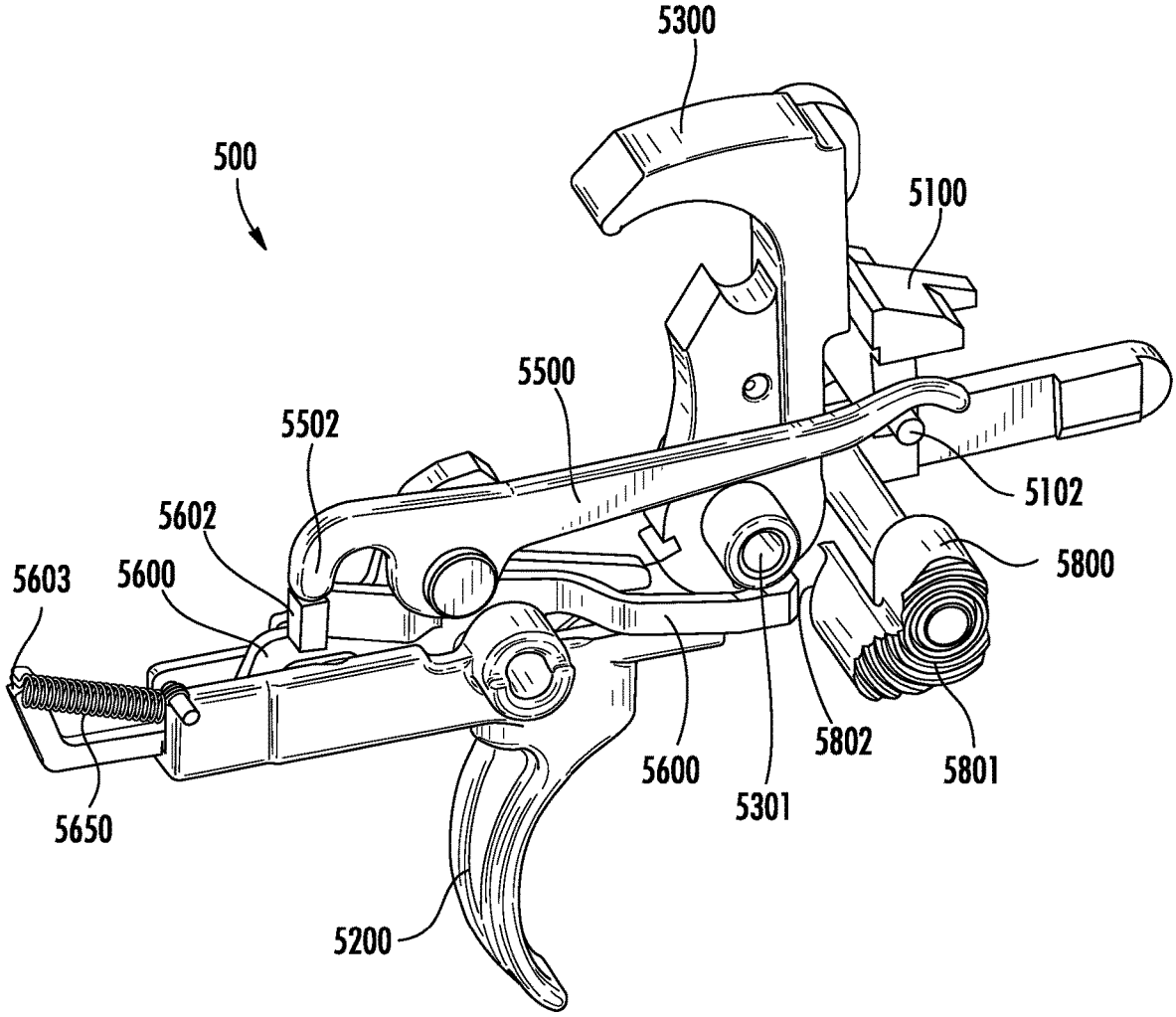
FIG. 23 is a partial perspective right side view of the firearm of FIG. 21.
Figure 24:
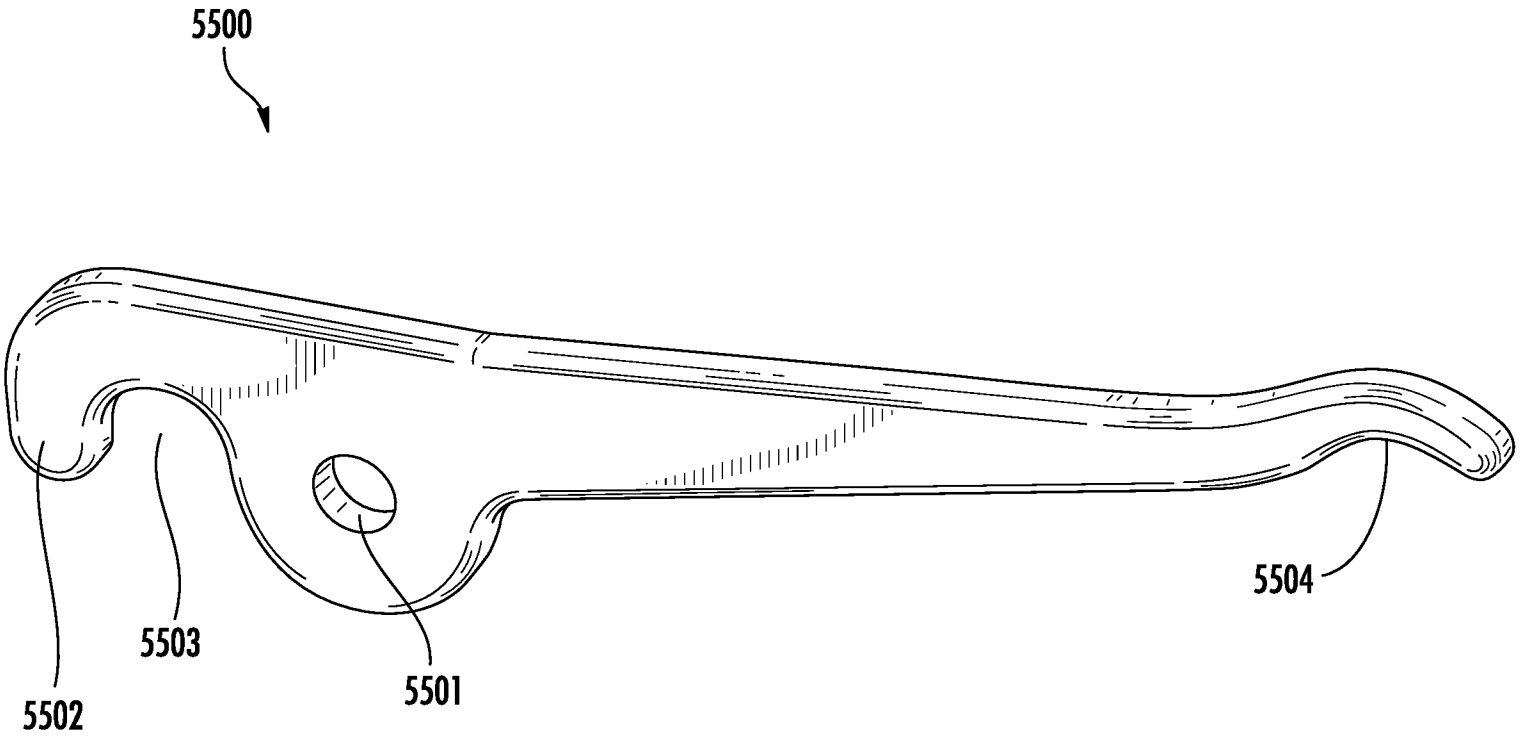
FIG. 24 is a perspective view of a lever arm of the firearm of FIG. 21.
Figure 26:
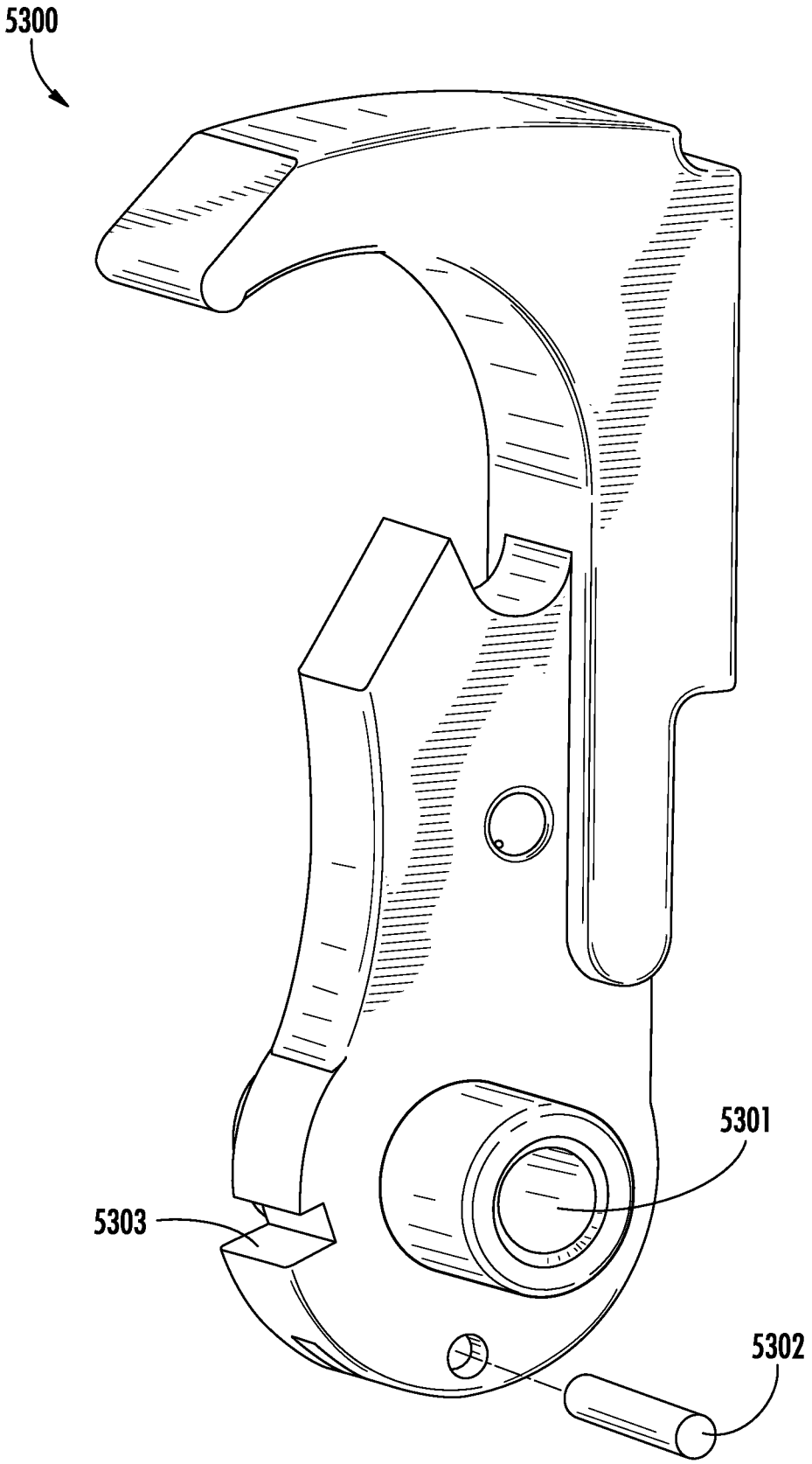
FIG. 26 is a perspective view of a hammer of the firearm of FIG. 21.

As shown in FIGS. 22, 23, and 26, an operator of the firearm can pivot the trigger 5200 to cause a forward portion of the trigger 5200 to interface with the hammer 5300 (in particular, sear protrusion 5303). The trigger 5200 rotates about hole 5201. In some embodiments, when the operator pulls the trigger 5200 to a firing position (not shown), the hammer 5300 is released and moves to a firing position to contact a firing pin after the hammer 5300 rotates about hole 5301. The hammer 5300 is shown rotated to the firing position in FIGS. 21-23. After a round is fired, the rearward movement of the bolt causes the hammer 5300 to rotate about hole 5301 (away from the firing pin) such that the hammer 5300 engages the disconnector 5400. After the operator releases the trigger 5200 (i.e., removes pressure form the trigger or no longer pulls the trigger), the trigger rotates about hole 5201 such that the disconnector 5400 rotates with the trigger 5200 and releases the hammer 5300. The hammer 5300 then rotates about hole 5301 until sear protrusion 5303 engages the trigger 5200. The firearm is then ready to fire a subsequent round such that the operator may pull the trigger 5200 to rotate about hole 5201, which will disengage the trigger 5200 from the sear protrusion 5303 (such that the hammer 5300 rotates toward the firing pin).

Figure 25:
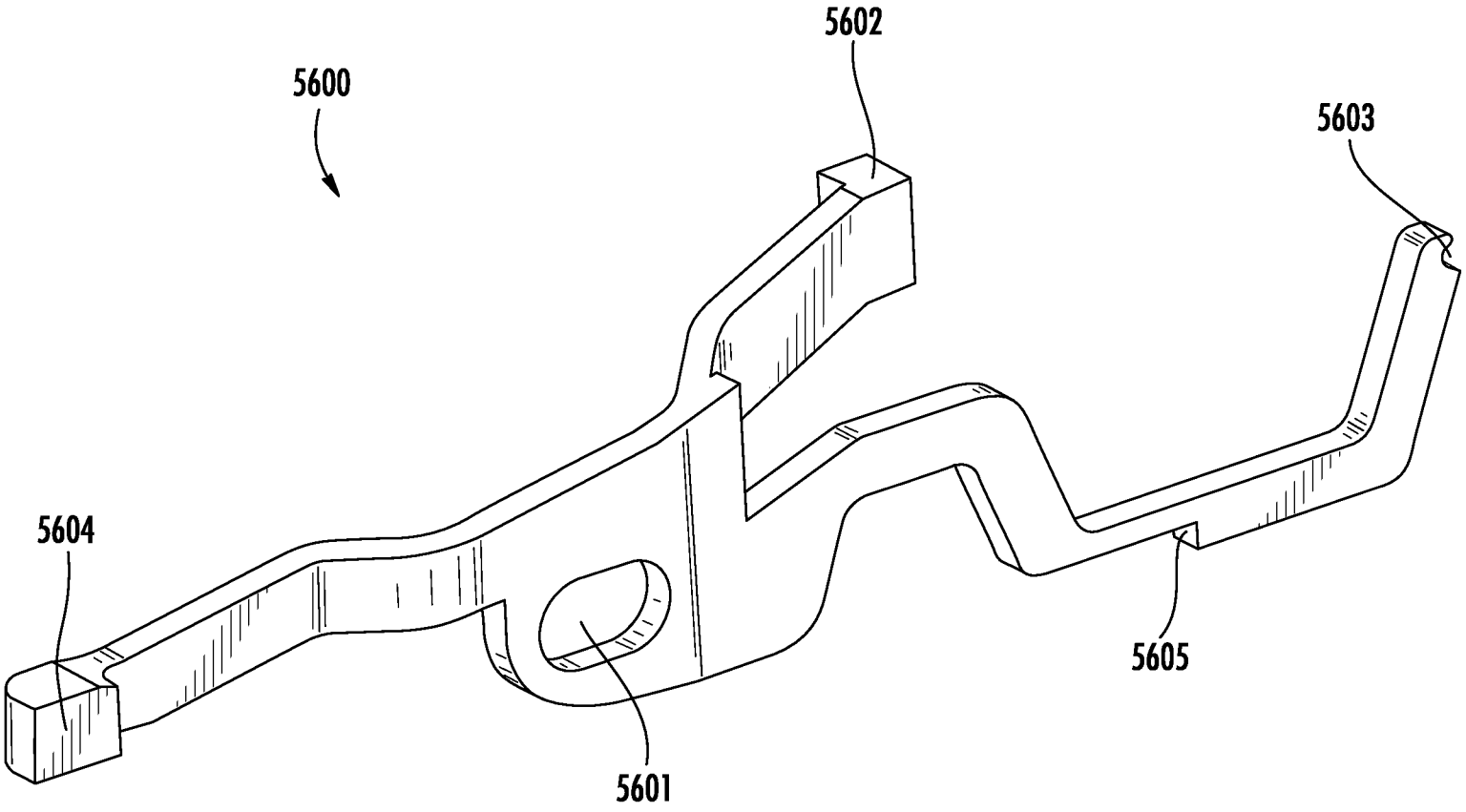
FIG. 25 is a perspective view of a sliding arm of the firearm of FIG. 21.

In some embodiments, rotation of the hammer 5300 to the firing position (as shown in FIGS. 21-23) causes pin 5302 (see FIG. 26) of the hammer 5300 to contact portion 5604 of the sliding arm 5600, which causes the sliding arm 5600 to rotate about hole 5601. Although not necessarily required, the hole 5601 may be a slotted or elongated hole as shown in FIG. 25. The contact from the pin 5302 causes portion 5604 to move down such that sliding arm 5600 rotates about hole 5601. In some embodiments, hole 5601 is coaxial with hole 5201 of the trigger 5200. In other words, if hole 5601 is slotted, hole 5201 overlaps with a portion of hole 5601. Movement of the portion 5604 down causes the opposite end of the sliding arm 5600 to move up such that notch 5605 disengages from trigger 5200. When notch 5605 is disengaged from trigger 5200, spring 5650 pulls sliding arm 5600 toward the front of the firearm. As shown in FIG. 23, the spring 5650 extends between mounting portion 5603 at the rear end of the sliding arm 5600 and a pin at the rear of the trigger 5200. When the sliding arm 5600 is pushed forward by the spring (i.e., when the notch 5605 is disengaged from the trigger 5200), the upper protrusion 5602 is aligned with recess 5503 of the lever arm 5500 such that upward movement of the upper protrusion 5602 (caused by rotation of the trigger 5200) does not affect the lever arm 5500. In other words, after the hammer 5300 is released and moves to the firing position, pivoting movement of the sliding arm 5600) does not affect the lever arm 5500.

After the last round is fired from a magazine, the bolt would be held in an open or rearward position (typically due to the follower in the magazine). In this condition (bolt held open), the operator of the firearm often will press the magazine release button 5801 (see FIGS. 22 and 23) to remove the empty magazine (and the operator will subsequently insert a full magazine). In some embodiments, pressing the magazine release button 5801 causes a contact surface 5802 to push against the forward-most portion of portion 5604 causing the sliding arm 5600 to move rearward (pushing against spring 5650) until the notch 5605 engages the trigger 5200 (which holds the sliding arm 5600 in a rear position, as shown in FIG. 23). When the sliding arm 5600 is in the rear position, the upper protrusion 5602 is aligned with protrusion 5502 of the lever arm 5500. After inserting a full magazine, in a conventional firearm, to release the bolt and cycle the firearm and load a round from the magazine into the chamber, the operator has to move at least one hand relative to the firearm to reach the external portion of the bolt release 5100 (see FIGS. 21 and 22). For the embodiments described herein, in addition to the standard external button, the operator has the option of leaving both hands on the firearm and pulling the trigger, which causes the sliding arm 5600 to rotate about hole 5601 such that upper protrusion 5602 moves upward and contacts protrusion 5502, which in turn causes the lever arm 5500 to rotate about hole 5501. When the lever arm 5500 rotates such that the protrusion 5502 moves up, the engaging portion 5504 moves down (see FIG. 24). The engaging portion 5504, when moving down, engages the pin 5102 of the bolt release 5100 such that the bolt release 5100 rotates about hole 5101. In other words, the operator can pull the trigger to release the bolt from the open or rearward position such that the bolt moves to a closed or forward position.

The components of any of the firearms described herein may be formed of materials including, but not limited to, carbon composite, plastic, thermoplastic, nylon, steel, aluminum, stainless steel, high strength aluminum alloy, other plastic or polymer materials, other metallic materials, other composite materials, or other similar materials. Moreover, the components of the firearms may be attached to one another via suitable fasteners, which include, but are not limited to, screws, bolts, rivets, welds, co-molding, injection molding, or other mechanical or chemical fasteners.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A firearm operating system comprising:

a central pivoting member; and a trigger comprising a hole and at least two fingers that extend in a first direction from the hole, wherein:

due to movement of the trigger in a counter-clockwise direction when viewed from a left side of the firearm operating system, the at least two fingers press against the central pivoting member to cause the central pivoting member to rotate; and the trigger is decoupled from the central pivoting member.

2. The firearm operating system of claim 1, further comprising a striker, wherein:

the central pivoting member comprises a first end and a second end opposite of the first end;

the at least two fingers are disposed adjacent to the first end; and the second end comprises a striker release and is disposed adjacent to the striker.

3. The firearm operating system of claim 2, wherein:

the central pivoting member is disposed above the trigger;

the first end is configured to move upwards based on movement of the central pivoting member while in direct contact with the at least two fingers; and the second end and the striker release are configured to move down based on movement of the central pivoting member.

4. The firearm operating system of claim 2, further comprising a safety striker stopper, wherein:

the central pivoting member comprises a safety finger disposed on an upper surface of the central pivoting member and the safety finger is disposed adjacent to the safety striker stopper;

the safety finger is disposed between the first end and the second end; and the safety finger is configured to move upwards based on movement of the central pivoting member while in direct contact with the safety striker stopper.

5. The firearm operating system of claim 2, further comprising a safety, wherein the safety is configured to prevent rotation of the central pivoting member.

6. The firearm operating system of claim 5, wherein the safety comprises a pivoting lever configured to interface with a safety portion disposed at the second end of the central pivoting member.

7. The firearm operating system of claim 5, wherein the safety comprises a pivot disposed adjacent to a bottom of the safety and the safety comprises a rear portion of a grip.

8. The firearm operating system of claim 1, wherein the trigger comprises a head that extends in a second direction from the hole where the second direction is opposite of the first direction, the head being disposed adjacent to a locking ring and a locking ring push-puller.

9. The firearm operating system of claim 8, wherein the head is configured to move the locking ring and the locking ring push-puller to allow removal of a lock block and barrel from the firearm operating system.

10. The firearm operating system of claim 1, further comprising a magazine release button disposed in a trigger guard, wherein the magazine release button is disposed forward of the trigger and the magazine release button comprises at least one ramped surface such that when the magazine release button is pressed in a lateral direction, the at least one ramped surface is configured to force a magazine release lever to pivot.

11. The firearm operating system of claim 1, further comprising a magazine release button disposed in a trigger guard, wherein the magazine release button comprises a first channel and a second channel such that a tab at a lower end of the trigger will align with the first channel when the magazine release button is pushed in a third direction and the lower end of the trigger will align with the second channel when the magazine release button is pushed in a fourth direction.

12. The firearm operating system of claim 1, wherein the trigger comprises at least one protrusion configured to release a slide assembly based on motion of the trigger.

13. A firearm operating system comprising:

a central pivoting member; and a trigger comprising a hole and at least one finger that extends in a first direction from the hole, wherein:

due to movement of the trigger, the at least one finger presses against surface of the central pivoting member further from a firearm slide to cause the central pivoting member to rotate; and the central pivoting member rotates about a pivot hole that is approximately halfway along a length of the central pivoting member.

14. The firearm operating system of claim 13, further comprising a striker, wherein:

the central pivoting member comprises a first end and a second end opposite of the first end;

the at least one finger is disposed adjacent to the first end; and the second end comprises a striker release and is disposed adjacent to the striker.

15. The firearm operating system of claim 13, further comprising a safety, wherein the safety is configured to prevent rotation of the central pivoting member.

16. The firearm operating system of claim 15, wherein the safety comprises a pivoting lever configured to interface with a safety portion disposed at the second end of the central pivoting member.

17. The firearm operating system of claim 15, wherein the safety comprises a pivot disposed adjacent to a bottom of the safety and the safety comprises a rear portion of a grip.

18. The firearm operating system of claim 13, wherein the trigger comprises a head that extends in a second direction from the hole where the second direction is opposite of the first direction, the head being disposed adjacent to a locking ring and a locking ring push-puller.

19. The firearm operating system of claim 18, wherein the head is configured to move the locking ring and the locking ring push-puller to allow removal of a lock block and barrel from the firearm operating system.

20. A firearm operating system comprising:

a central pivoting member; and a trigger comprising a hole and at least two fingers that extend in a first direction from the hole, wherein:

due to movement of the trigger causing the firearm operating system to fire a round, prior to trigger reset, the at least two fingers press against the central pivoting member to cause the central pivoting member to rotate; and the trigger is decoupled from the central pivoting member.

* * * * *